US009625866B2

(12) United States Patent
Aoyama et al.

(10) Patent No.: US 9,625,866 B2
(45) Date of Patent: Apr. 18, 2017

(54) IMAGE FORMING APPARATUS

(71) Applicants: Jumpei Aoyama, Kanagawa (JP); Hajime Nishida, Kanagawa (JP); Hideki Tobinaga, Kanagawa (JP); Junpei Kamichi, Tokyo (JP); Satoshi Kuno, Tokyo (JP); Shun Kobayashi, Kanagawa (JP); Manabu Nonaka, Kanagawa (JP)

(72) Inventors: Jumpei Aoyama, Kanagawa (JP); Hajime Nishida, Kanagawa (JP); Hideki Tobinaga, Kanagawa (JP); Junpei Kamichi, Tokyo (JP); Satoshi Kuno, Tokyo (JP); Shun Kobayashi, Kanagawa (JP); Manabu Nonaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/533,449

(22) Filed: Nov. 5, 2014

(65) Prior Publication Data

US 2015/0132040 A1 May 14, 2015

(30) Foreign Application Priority Data

Nov. 8, 2013 (JP) ..... 2013-232152

(51) Int. Cl.
*G03G 15/00* (2006.01)

(52) U.S. Cl.
CPC ..... *G03G 15/6511* (2013.01); *G03G 15/6514* (2013.01)

(58) Field of Classification Search
CPC ..... G03G 15/6511; G03G 2215/00396; G03G 2215/004; B65H 3/0615; B65H 3/0653;
(Continued)

(56) References Cited

U.S. PATENT DOCUMENTS 4,852,868 A * 8/1989 Fukui ..... B65H 3/5261 271/122
5,265,864 A * 11/1993 Roux ..... B65H 15/00 271/186

(Continued)

FOREIGN PATENT DOCUMENTS

JP 4-338038 11/1992
JP 2001-026329 1/2001

(Continued)

*Primary Examiner* — Blake A Tankersley
*Assistant Examiner* — Ruben Parco, Jr.
(74) *Attorney, Agent, or Firm* — Harness, Dickey & Pierce, P.L.C.

(57) ABSTRACT

An image forming apparatus includes an apparatus body, a sheet container detachably attachable to the apparatus body and accommodating recording media therein, an image forming part to form an image on each of the recording media, a sheet separating part to separate the recording media one by one, feed the recording medium toward the image forming part, and include a sheet feeding body and a sheet separating body to rotate in contact with the sheet feeding body and form a sheet separation nip region with the sheet feeding body, a sheet containing unit to contain the recording media therein, and a sheet separating body storing unit disposed at one end of the sheet containing unit to store the sheet separating body therein. The sheet container being pulled out from the apparatus body by moving from the sheet containing unit to the sheet separating body storing unit.

12 Claims, 14 Drawing Sheets

(58) Field of Classification Search
CPC ..... B65H 3/52; B65H 2301/4232; B65H 2301/42324; B65H 2301/4234; B65H 2405/313; B65H 2405/325; B65H 3/68; B65H 2301/5122
See application file for complete search history.

(56) References Cited

U.S. PATENT DOCUMENTS

| | | | | |
|---|---|---|---|---|
| 8,833,757 | B1 * | 9/2014 | Piening | B65H 3/0684 271/121 |
| 2005/0074266 | A1 * | 4/2005 | Hiramoto | B65H 1/26 399/391 |
| 2006/0237895 | A1 * | 10/2006 | Nishikata | B65H 3/0669 271/121 |
| 2009/0001657 | A1 * | 1/2009 | Yamaguchi | B65H 1/266 271/164 |
| 2009/0115123 | A1 * | 5/2009 | Toba | G03G 15/6511 271/171 |
| 2009/0200733 | A1 * | 8/2009 | Saito | B65H 29/70 271/225 |
| 2009/0200736 | A1 * | 8/2009 | Seki | B65H 29/125 271/314 |
| 2011/0204557 | A1 | 8/2011 | Ishikawa et al. | |
| 2011/0204558 | A1 | 8/2011 | Takahashi et al. | |
| 2011/0304092 | A1 | 12/2011 | Kambayashi et al. | |
| 2012/0061903 | A1 | 3/2012 | Eguchi et al. | |
| 2012/0061904 | A1 | 3/2012 | Higaki et al. | |
| 2012/0126475 | A1 * | 5/2012 | Shin | B65H 1/266 271/117 |
| 2012/0170960 | A1 | 7/2012 | Nishida et al. | |
| 2012/0193861 | A1 | 8/2012 | Takahashi et al. | |
| 2012/0228817 | A1 | 9/2012 | Kobayashi et al. | |
| 2012/0230745 | A1 | 9/2012 | Kobayashi et al. | |
| 2012/0235346 | A1 | 9/2012 | Ikeda et al. | |
| 2012/0306146 | A1 | 12/2012 | Higaki et al. | |
| 2012/0314267 | A1 | 12/2012 | Suzuki et al. | |
| 2013/0161894 | A1 | 6/2013 | Ishikawa et al. | |
| 2013/0300052 | A1 | 11/2013 | Nishida et al. | |
| 2014/0001699 | A1 | 1/2014 | Ishikawa et al. | |
| 2014/0070479 | A1 | 3/2014 | Toyooka et al. | |
| 2014/0183813 | A1 | 7/2014 | Aoyama | |
| 2014/0210157 | A1 | 7/2014 | Aoyama | |
| 2014/0212195 | A1 | 7/2014 | Aoyama | |
| 2014/0252713 | A1 * | 9/2014 | Masubuchi | B65H 85/00 271/10.11 |

FOREIGN PATENT DOCUMENTS

| | | | | |
|---|---|---|---|---|
| JP | 2001-088947 A | | 4/2001 | |
| JP | 2002-307737 | | 10/2002 | |
| JP | 2006-089219 | | 4/2006 | |
| JP | 2008-094528 | | 4/2008 | |
| JP | 2010-037097 | | 2/2010 | |
| JP | 2010058897 A | * | 3/2010 | B65H 3/06 |
| JP | 2012-166912 | | 9/2012 | |

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-232152, filed on Nov. 8, 2013 in the Japan Patent Office, the entire disclosure of which is hereby incorporated by reference herein.

BACKGROUND

Technical Field

This disclosure relates to an image forming apparatus in which multiple recording media accumulated as a sheet stack in a sheet container pass one by one through a sheet separation nip region formed by a sheet feeding body and a sheet separating body to separate a recording medium that directly contact the sheet feeding body out of the multiple recording media and to feed the recording medium from the sheet container toward an image forming part provided in the image forming apparatus.

Related Art

As an example of known image forming apparatuses, some image forming apparatuses do not include a pickup roller and causes a sheet feed roller to function as a pickup roller. This configuration can achieve a reduction in cost without a pickup roller.

Such a known sheet feed roller form a sheet separation nip region with a sheet separating roller. A recording medium is held in the sheet separation nip region formed between the sheet feed roller and the sheet separating roller to be separated from the other recording media in the sheet container and be fed toward the image forming part further passing through some other nip regions including a sheet conveyance nip region formed downstream from the sheet separation nip region in a sheet conveying direction.

When a paper jam occurs in a vicinity of the sheet separation nip region, a jammed sheet is generally held in the sheet conveyance nip region at a leading end thereof and in the sheet separation nip region at a trailing end thereof. In order to remove an image foaming apparatus having the above-described configuration, the sheet container that is attached to an apparatus body of the image forming apparatus is slidably detached from the apparatus body, so that a user can insert the hand into the apparatus body and grab the jammed sheet to be removed.

SUMMARY

At least one aspect of this disclosure provides an image forming apparatus including an apparatus body, a sheet container detachably attachable to the apparatus body and accommodating recording media therein, an image forming part to form an image on each of the recording media accommodated in the sheet container, a sheet separating part to separate the recording media one by one from the sheet container and feed the recording medium toward the image forming part and to include a sheet feeding body that has a rotary shaft and rotates about the rotary shaft thereof and a sheet separating body that has a rotary shaft, is held on the sheet container, is detachably attachable to the apparatus body together with the sheet container, and rotates in contact with the sheet feeding body and forming a sheet separation nip region with the sheet feeding body, a sheet containing unit included in the sheet container to contain the recording media therein, and a sheet separating body storing unit included in the sheet container and disposed at one end of the sheet containing unit to store the sheet separating body therein. The sheet container is pulled out from the apparatus body by moving from the sheet containing unit to the sheet separating body storing unit.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
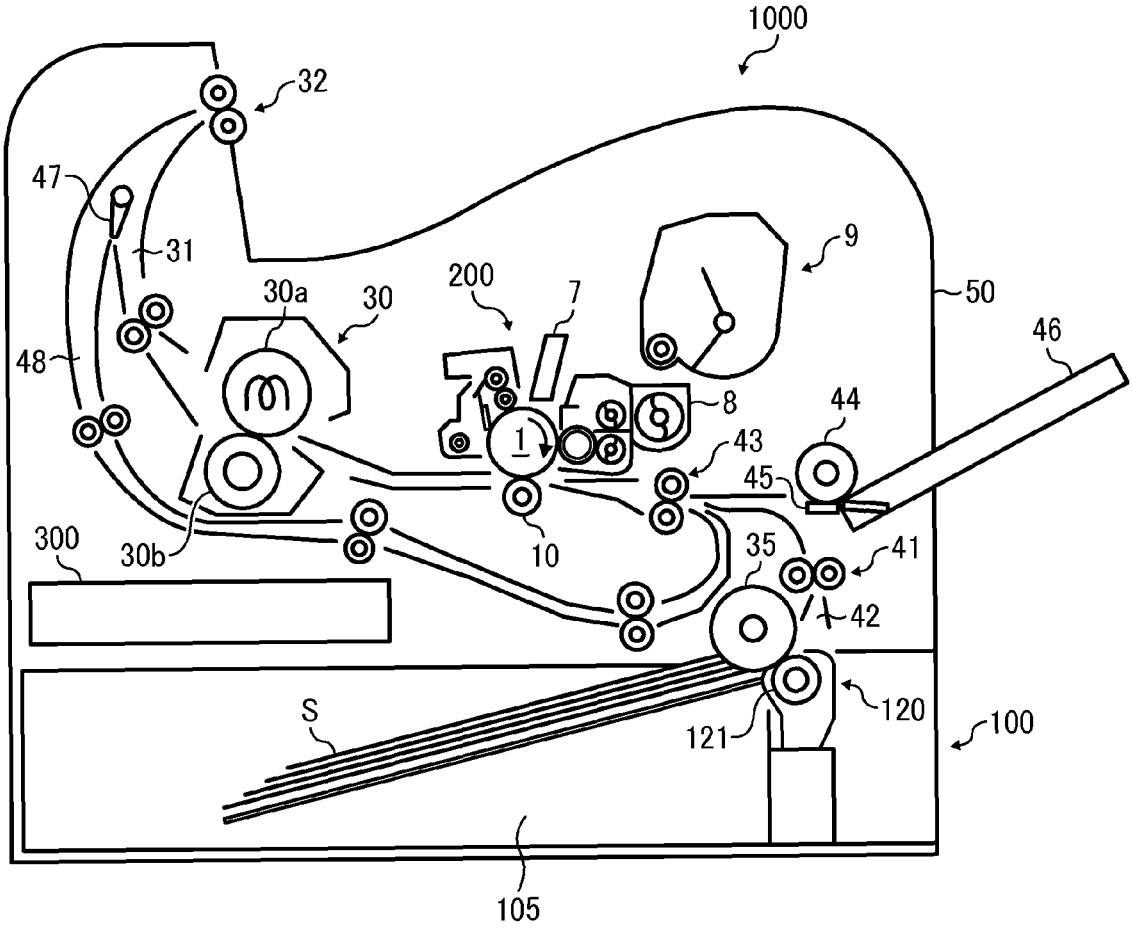
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative teams are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 1000 for forming images by electrophotography.

The image forming apparatus 1000 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1000 is an electrophotographic printer that forms toner images on a sheet or sheets by electrophotography.

More specifically, the image forming apparatus 1000 functions as a printer. However, the image forming apparatus 1000 can expand its function as a copier by adding a scanner as an option disposed on top of an apparatus body of the image forming apparatus 1000. The image forming apparatus 1000 can further obtain functions as a facsimile machine by adding an optional facsimile substrate in the apparatus body of the image forming apparatus 1000.

Further, this disclosure is also applicable to image forming apparatuses adapted to form images through other schemes, such as known ink jet schemes, known toner projection schemes, or the like as well as to image forming apparatuses adapted to form images through electro-photographic schemes.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

At first, a description is given of a basic configuration of the image forming apparatus 1000 according to an example of this disclosure.

FIG. 1 is a diagram illustrating the image forming apparatus 1000.

In FIG. 1, the present image forming apparatus 1000 includes an apparatus body 50, a photoconductor 1 and a sheet tray 100.

The photoconductor 1 functions as a latent image carrier.

The sheet tray 100 functions as a sheet container that is detachably attachable to the apparatus body 50. The sheet tray 100 includes multiple sheets S in a form of a sheet stack.

A sheet S in the sheet tray 100 is fed from the sheet tray 100 as a sheet feed roller 35 rotates, passes through a sheet separation nip region, and reaches a sheet conveying path 42. Thereafter, the sheet S is held by a first conveying roller pair 41 in the sheet conveying nip region and is conveyed from an upstream side toward a downstream side in the sheet conveying direction in the sheet conveying path 42. A registration roller pair 43 is disposed in a vicinity of a terminal end of the sheet conveying path 42. Conveyance of the sheet S is temporarily stopped with the leading edge of the sheet S abutting against a registration nip area of the registration roller pair 43. During the abutment of the sheet S, skew of the sheet S is corrected.

The registration roller pair 43 starts driving to feed the sheet S toward the transfer nip region so as to synchronize rotation of the registration roller pair 43 with movement of the sheet S, so that the toner image formed on the surface of the photoconductor 1 is transferred onto the sheet in a transfer nip region. At this time, the first conveying roller pair 41 starts driving at the same time as the rotation of the registration roller pair 43 to resume conveyance of the sheet S that has been halted.

The apparatus body 50 of the image forming apparatus 1000 contains a bypass tray unit including a bypass tray 46, a bypass feed roller 44, and a sheet separation pad 45. The sheet S that is loaded on the bypass tray 46 of the bypass tray unit is fed from the bypass tray 46 due to rotation of the bypass feed roller 44. After passing through the sheet separation nip region formed by the bypass feed roller 44 and the sheet separation pad 45, the sheet S enters an upstream region located upstream from the registration roller pair 43 in the sheet conveying path 42 in the sheet conveying direction. Thereafter, similarly to the sheet S discharged from the sheet tray 100, the sheet S is conveyed to the transfer nip region after passing through the registration roller pair 43.

Figure 2:
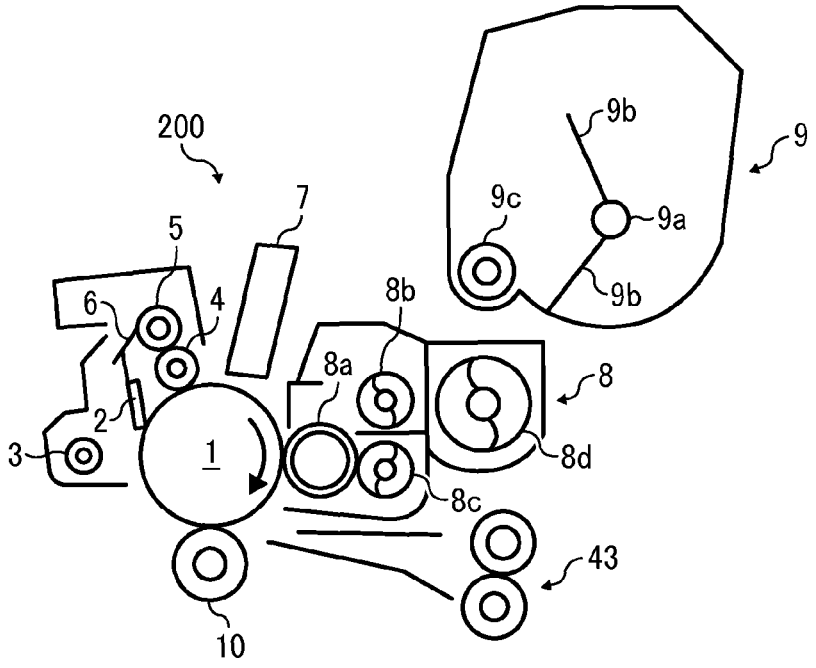
FIG. 2 is an enlarged view illustrating an image forming part including a photoconductor and image forming units disposed around the photoconductor included in the image forming apparatus of FIG. 1.

FIG. 2 is an enlarged view illustrating an image forming part 200 including the photoconductor 1 and image forming devices disposed around the photoconductor 1 included in the image forming apparatus 1000 of FIG. 1.

The photoconductor 1 is a drum-shaped photoconductor that rotates clockwise in FIG. 2. The image forming devices disposed around the photoconductor 1 are a toner collection screw 3, a cleaning blade 2, a charging roller 4, a latent image writing device 7, a developing device 8, a transfer roller 10, and the like.

The charging roller 4 includes a conductive rubber roller and forms a charging nip region by rotating while being in contact with the photoconductor 1. A charging bias that is outputted from a power source is applied to the charging roller 4. Thus, in the charging nip region, an electrical discharge is induced between the surface of the photoconductor 1 and a surface of the charging roller 4. As a result, the surface of the photoconductor 1 is uniformly charged.

The latent-image writing device 7 includes an LED array and performs light scanning with LED light over the surface of the photoconductor 1 that has been uniformly charged. On a ground surface of the photoconductor 1 that has been uniformly charged, the area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region that is located facing the developing device 8.

The developing device 8 includes a circulation conveying portion and a developing portion. The circulation conveying portion accommodates developer containing toner and magnetic carriers. The circulation conveying portion includes a first screw 8*b* for conveying the developer to be supplied to a developing roller 8*a*, and a second screw 8*c* for conveying the developer in an independent space positioned beneath the first screw 8*b*. Further, the circulation conveying portion includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

The first screw 8*b* conveys the developer from a distal side toward a proximal side in a direction perpendicular to the drawing sheet of FIG. 2 as the first screw 8*b* rotates. At this time, the first screw 8*b* supplies a portion of the developer to the developing roller 8*a* that is disposed opposite to the first screw 8*b*. The developer having been conveyed by the first screw 8*b* to the vicinity of a proximal end portion of the first screw 8*b* in the direction perpendicular to the drawing sheet of FIG. 2 is dropped onto the second screw 8*c*.

The second screw 8*c* receives used developer from the developing roller 8*a* and at the same time conveys the received developer from the distal side toward the proximal side in the direction perpendicular to the drawing sheet of FIG. 2 as the second screw 8*c* rotates. The developer conveyed by the second screw 8*c* to the vicinity of the end portion thereof that is close in the direction perpendicular to the drawing sheet of FIG. 2 is supplied to the inclined screw 8*d*. Further, along with rotation of the inclined screw 8*d*, the developer is conveyed from the proximal side toward the distal side in the direction perpendicular to the drawing sheet of FIG. 2. Thereafter, the developer is supplied to the first screw 8*b* in the vicinity of the distal end portion thereof in the direction perpendicular to the drawing sheet of FIG. 2.

The developing roller 8*a* includes a rotatable developing sleeve and a magnet roller. The rotatable developing sleeve is a tubular-shaped non-magnetic member. The magnet roller is fixed to the developing sleeve in such a way as not to rotate together with the developing sleeve. Further, the developing roller 8*a* takes up a portion of the developer that is conveyed by the first screw 8*b* onto the surface of the developing sleeve due to a magnetic force generated by the magnet roller. The developer that is carried on the surface of the developing sleeve passes through an opposite position facing a doctor blade. At this time, the thickness of a layer of the developer on the surface of the developing sleeve is restricted while the developer is rotated together with the surface of the development sleeve. Thereafter, the developing roller 8*a* moves while sliding against the surface of the photoconductor 1 in the developing area in which the developing roller 8*a* faces the photoconductor 1.

A development bias having the same polarity as the toner and an electric potential at the surface of the photoconductor 1 is applied to the developing sleeve. The absolute value of this development bias is greater than the absolute value of electric potential of the latent image and is smaller than the absolute value of the electric potential at the surface. Therefore, in the development area, a development potential acts between the developing sleeve and the electrostatic latent image formed on the photoconductor 1 in such a way as to electrostatically move the toner from the developing sleeve to the latent image. By contrast, a background potential acts between the development sleeve and the ground surface of the photoconductor 1 to electrostatically move the toner from the background surface to the developing sleeve. This causes the toner to selectively adhere to the electrostatic latent image formed on the photoconductor 1, so that the electrostatic latent image is developed in the development area.

The developer that has passed through the development area enters an opposite area in which the developing sleeve faces the second screw 8*c* as the developing sleeve rotates. In the opposite area, a repulsive magnetic field is formed by two magnetic poles having polarities different from each other out of multiple magnetic poles included in the magnet roller. The developer that has entered the opposite area is separated from the surface of the developing sleeve and is collected by the second screw 8*c* due to the effect of the repulsive magnetic field.

The developer that is conveyed by the inclined screw 8*d* contains the developer that has been collected from the developing roller 8*a*, and this developer is contributed to development in the development area, so that the toner concentration is lowered. The developing device 8 includes a toner concentration sensor for detecting the toner concentration of the developer to be conveyed by the inclined screw 8*d*.

Based on detection results obtained by the toner concentration sensor, a controller 300 outputs a replenishment operation signal for replenishing the toner to the developer that is conveyed by the inclined screw 8*d*, as required.

A toner cartridge 9 is disposed above the developing device 8 and includes a rotary shaft 9*a*, agitators 9*b*, and a toner replenishment member 9*c*, as illustrated in FIG. 2. The toner cartridge 9 agitates the toner contained therein with the agitators 9*b* fixed to the rotary shaft 9*a*. Further, the toner replenishment member 9*c* is driven to rotate according to the replenishment operation signal outputted from the controller 300. With this operation, the toner in an amount corresponding to a rotation amount of the toner replenishment member 9*c* is replenished to the inclined screw 8*d* of the developing device 8.

The toner image formed on the photoconductor 1 as a result of the development enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the registration roller pair 43 conveys the sheet S toward the transfer nip region in synchronization with a timing at which the toner image formed on the photoconductor 1 is overlaid onto the sheet S in the transfer nip region. The toner image formed on the photoconductor 1 is transferred onto the sheet S that is closely contacted to the toner image in the transfer nip region due to the actions of the electric field in the transfer nip region and the nip pressure.

Residual toner that is not transferred onto the sheet S remains on the surface of the photoconductor 1 after having passed through the transfer nip region. The residual toner is scraped off from the surface of the photoconductor 1 by the cleaning blade 2 that is in contact with the photoconductor 1 and, thereafter, is transmitted toward an outside of a unit casing by the collection screw 3. The residual toner that is removed from the unit casing is transported to a waste toner bottle by a conveying device.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 adhere to the charging roller 4 that is in contact with the surface of the photoconductor 1. These foreign materials are shifted to a cleaning roller 5 that is in contact with the charging roller 4. Thereafter, the foreign materials are scraped off from the surface of the cleaning roller 5 by a scraper 6 that is in contact with the cleaning roller 5. The foreign materials scraped off from the surface of the cleaning roller 5 falls onto the toner collection screw 3.

In FIG. 1, the sheet S that has passed through the transfer nip region formed by the photoconductor 1 and the transfer roller 10 contacting each other is conveyed to a fixing device 30. The fixing device 30 includes a fixing roller 30*a* and a pressure roller 30*b*. The fixing roller 30*a* includes a heat generating source such as a halogen lamp. The pressure roller 30*b* is pressed against the fixing roller 30*a*. The fixing roller 30*a* and the pressure roller 30*b* contacting each other form a fixing nip region. The toner image is fixed to the surface of the sheet S that is held in the fixing nip region due to application of heat and pressure. Thereafter, the sheet S that has passed through the fixing device 30 passes through a sheet discharging path 31. Then, the sheet S is held in a sheet discharging nip region of a sheet discharging roller pair 32.

The image forming apparatus 1000 according to this example can switch or change modes between a single side printing mode and a duplex printing mode. The single side printing mode is a mode to form images on a single surface of each sheet S. The duplex printing mode is a mode to form images on both sides of each sheet S. In a case in which the single side printing mode is selected or in a case in which the duplex printing mode is selected when images have already been formed on both sides of the sheet S, the sheet discharging roller pair 32 is continuously driven to rotate in a forward direction. By so doing, the sheet S in the sheet discharging path 31 is discharged to an outside of the image forming apparatus 1000. The discharged sheet S is stacked in a stack portion provided on the upper surface of the apparatus body 50.

By contrast, when an image is formed on one side (i.e., a front face) of the sheet S in the duplex printing mode, the sheet discharging roller pair 32 is driven to reversely rotate at the timing when the end portion (e.g., the leading end) of the sheet S enters the sheet discharging nip region formed by the pair of the sheet discharging roller pair 32. At this time, a separating claw 47 that is disposed in the vicinity of an terminal end of the sheet discharging path 31 is activated to close the sheet discharging path 31 and open an entrance of a sheet reverse reentry path 48. The sheet S starts moving in a reverse direction to the sheet conveying direction as the sheet discharging roller pair 32 rotates reversely. Then, the sheet S is conveyed into the sheet reverse reentry path 48. Further, the sheet S is conveyed while being reversed upside down through the sheet reverse reentry path 48, and then is conveyed to the registration nip region of the registration roller pair 43 again. Then, after the toner image is transferred onto the other side (e.g., a reverse side) in the transfer nip region, the sheet S passes through the fixing device 30, the sheet discharging path 31, and the sheet discharging roller pair 32 to be discharged to the outside of the image forming apparatus 1000.

Figure 3:
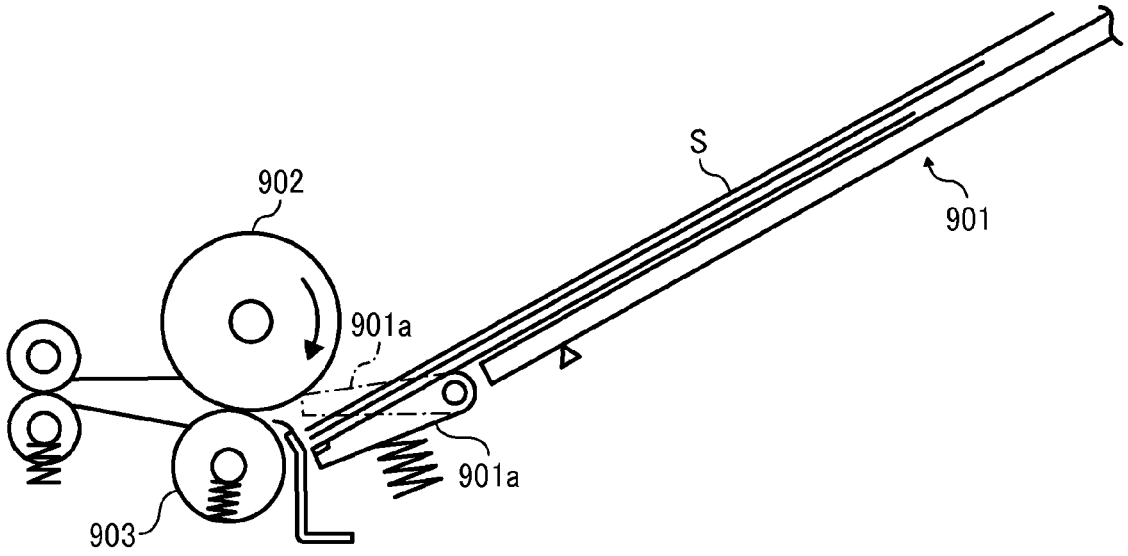
FIG. 3 is a diagram illustrating a comparative bypass tray included in a comparative image forming apparatus.
Figure 4:
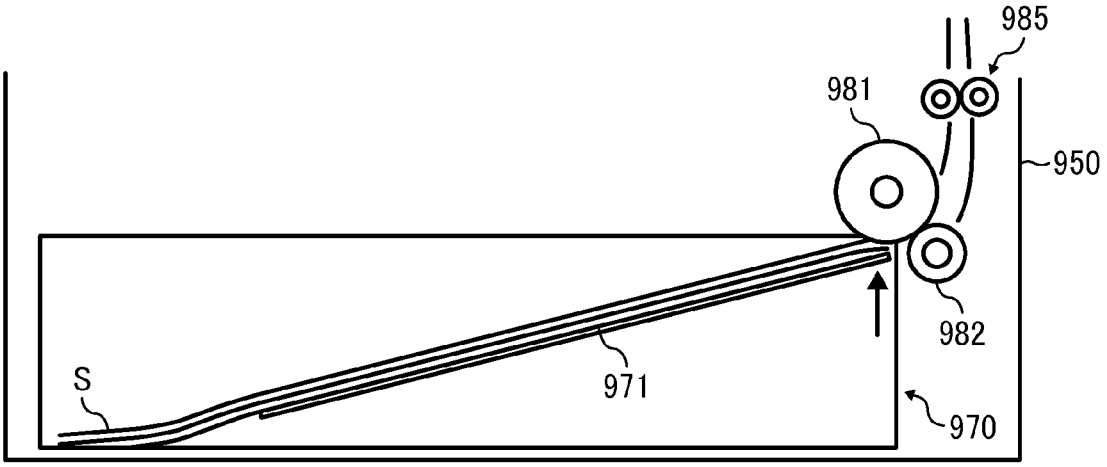
FIG. 4 is a diagram illustrating a schematic configuration of another comparative configuration of a sheet tray having a pickup-less structure, and units disposed around the sheet tray.

Now, a description is given of sheet trays provided to a comparative image forming apparatus according to comparative examples, with FIGS. 3 and 4.

FIG. 3 is a structural view illustrating a bypass tray in the comparative image forming apparatus. In FIG. 3, a sheet feed roller 902 and a sheet separation roller 903 contact each other to form a sheet separation nip region on the side of a bypass tray 901 that accommodates multiple sheets S in a state of a sheet stack. A movable plate 901*a* is provided at the leading end portion of the bypass tray 901 and is biased by a spring. By so doing, the leading end portions of the sheets S on the bypass tray 901 to abut against the sheet feed roller 902. When the sheet feed roller 902 is driven to rotate, a sheet S is fed from the bypass tray 901.

A torque limiter is disposed to support a rotary shaft of the sheet separation roller 903. Specifically, the torque limiter is coupled to a rotary shaft of the sheet separation roller 903.

If the sheet separation roller 903 that is directly in contact with the sheet feed roller 902 is rotated together with the sheet feed roller 902, a rotation torque exceeding a predetermined threshold value is induced to the rotary shaft member of the sheet separation roller 903. Thus, the torque limiter permits the sheet separation roller 903 to be rotated with the sheet feed roller 902 in a direction in which the sheet separation roller 903 follows rotation of the sheet feed roller 902.

In some cases, multi-feed may be induced. The multi-feed is a defect operation in which two or more sheets S are fed from the sheet tray 901 along with rotation of the sheet feed roller 902. If two or more sheets S are held by the sheet separation nip region due to the multi-feed, the sheet S that is directly in contact with the sheet feed roller 902 in the sheet stack of the sheets S is conveyed in a sheet feeding direction as a surface of the sheet feed roller 902 moves. At this time, this uppermost sheet S is moved while slipping on the surface of a subsequent sheet S or a second sheet S.

Due to this slipping, the rotation torque of the sheet separation roller 903, to which a rotating force is applied from the sheet feed roller 902 via the multiple sheets S interposed therebetween, is reduced to a value below the previously described threshold value.

Further, the torque limiter transmits a reverse-rotation driving force from a drive motor to the sheet separation roller 903. This causes the sheet separation roller 903 to start rotating reversely, so that the second sheet S and the other sheets S of the sheet stack are conveyed backwardly toward the bypass tray 901.

Through this backward conveyance, even in the event of the multi-feed, the sheet S that is directly in contact with the sheet feed roller 902 is separated therefrom and is transmitted to an image forming device constituted by a photoconductor and the like for forming images through known electrophotographic processing.

As a component for feeding the sheets placed in a sheet container such as a tray toward an image forming device, it is general to employ a pickup roller provided besides a sheet feed roller and a sheet separation roller.

However, the image forming apparatus described in this comparative example does not include a pickup roller and causes the sheet feed roller 902 to function as a pickup roller. With this structure, a reduction in cost can be achieved without a pickup roller.

As a component for accommodating a stack of sheets, known sheet trays are employed as well as bypass trays as illustrated in FIG. 3. Such known sheet trays are generally detachably attached to an apparatus body of an image forming apparatus and accommodate a larger amount of sheets than those in bypass trays. Such sheet trays can achieve cost reduction by employing a configuration in which sheets loaded in the sheet tray(s) are pressed against a sheet feed roller without a pickup roller (hereinafter, referred to as a pickup-less structure), similarly to the bypass tray 901 illustrated in FIG. 3.

FIG. 4 is a schematic structural view illustrating another comparative configuration of a sheet tray having a pickup-less structure, and units disposed around the sheet tray.

In FIG. 4, the sheet tray 970 that accommodates a stack of sheets S therein is detachably attached to the apparatus body 950 in the image forming apparatus. By contrast, a sheet feed roller 981 and a sheet separation roller 982 are rotatably fixed to an inside of the apparatus body 950. The leading end portions of the sheets S loaded in the sheet tray 970 are pressed against the sheet feed roller 981 by a movable plate 971. Due to this pressing, the sheet feed roller 981 functions as a member for feeding the sheets S loaded in the sheet tray 970 toward the sheet feeding path without using a pickup roller. By so doing, a cost reduction of the image forming apparatus can be achieved.

However, this configuration is likely to tear a jammed sheet when the jammed sheet is removed for eliminating a paper jam. More specifically, a jammed sheet generated in a vicinity of the sheet separation nip region is generally in a state in which a leading end thereof is held in a sheet conveying nip region of a sheet conveying roller pair 985 that exists downstream from the sheet separation nip region and a trailing end thereof is held in the sheet separation nip region. In the image forming apparatus illustrated in FIG. 4, if the sheet tray 970 is pulled out from the apparatus body 950 by sliding and moving the sheet tray 970 from a left side to a right side in FIG. 4, the sheet tray 970 is caught by the sheet separation roller 982. Therefore, the sheet tray 970 is not pulled out in a left-to-right direction in FIG. 4.

Further, in a case in which the sheet tray 970 is pulled out from the apparatus body 950 by sliding and moving the sheet tray 970 from the right side to the left side in FIG. 4, an opening of space formed in the apparatus body 950 after the sheet tray 970 is pulled out exists on the left side wall of the apparatus body 950 in FIG. 4. It is significantly difficult for a user to stretch his/her hand inserted through this opening to the trailing end of the jammed sheet existing in the vicinity of the sheet separation nip region at substantially an opposite position from the opening. Accordingly, it is not practical to employ the above-described configuration.

As a result thereof, it is considered that it is general to employ a configuration in which the sheet tray 970 is pulled out from the inside of the apparatus body 950 by sliding and moving the sheet tray 970 in the direction orthogonal to a sheet face of FIG. 4.

However, this configuration has an opening of space formed in the apparatus body 950 by pulling out the sheet tray 970 from the apparatus body 950 exists on a side wall that is proximal or distal to the direction orthogonal to the sheet face of FIG. 4. The user inserting his/her hand into the apparatus body 950 through this opening can grasp the jammed sheet at one end thereof in the direction orthogonal to the sheet conveying direction of the jammed sheet. Accordingly, when the jammed sheet is pulled out from the sheet separation nip region with the one end of the jammed sheet being grasped, the user tends to exert a concentrated pulling force to the one end thereof, so that the jammed sheet is easily torn.

Next, a description is given of the detailed configuration of the image forming apparatus 1000.

Figure 5:
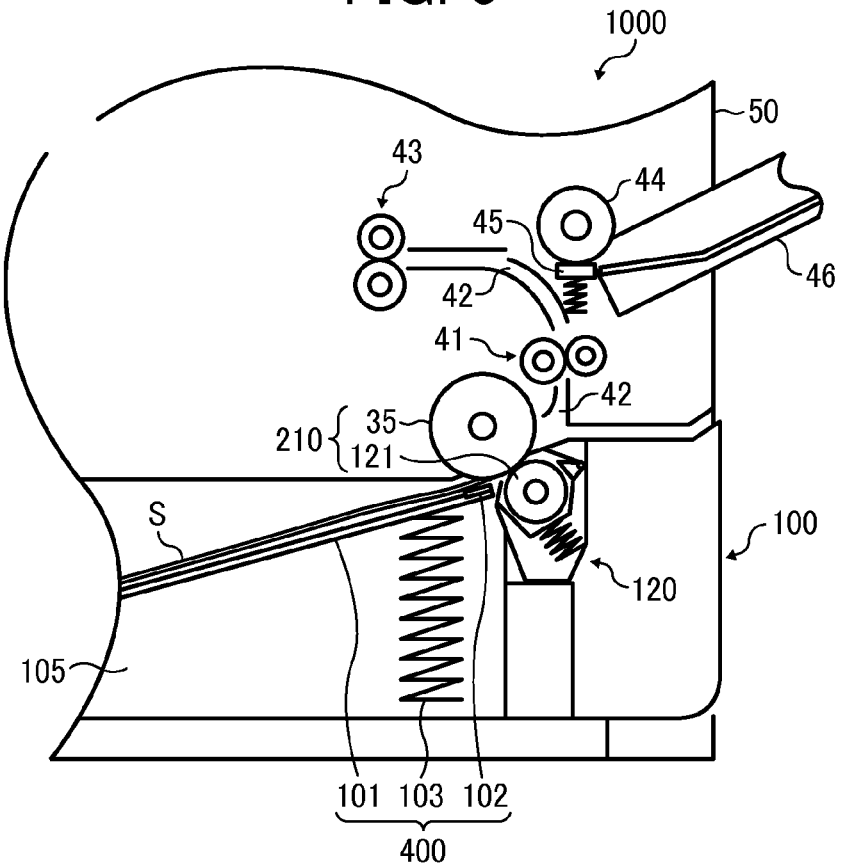
FIG. 5 is a partial enlarged view illustrating a lower part of the image forming apparatus of FIG. 1.

FIG. 5 is a partial enlarged view illustrating a lower part of the image forming apparatus 1000 of FIG. 1.

As illustrated in FIG. 5, the sheet tray 100 accommodates the sheet stack of the multiple sheets S loaded on a movable bottom plate 101. The movable bottom plate 101 is biased toward the sheet feed roller 35 by a bottom plate spring 103. A bottom plate pad 102 that is an elastic member is fixed the leading end portion of the movable bottom plate 101. The leading end portion of the sheet stack is pressed toward the sheet feed roller 35 by the force of the bottom plate spring 103 in a state in which the leading end portion of the sheet stack is sandwiched between the bottom plate pad 102 and the sheet feed roller 35.

Figure 14:
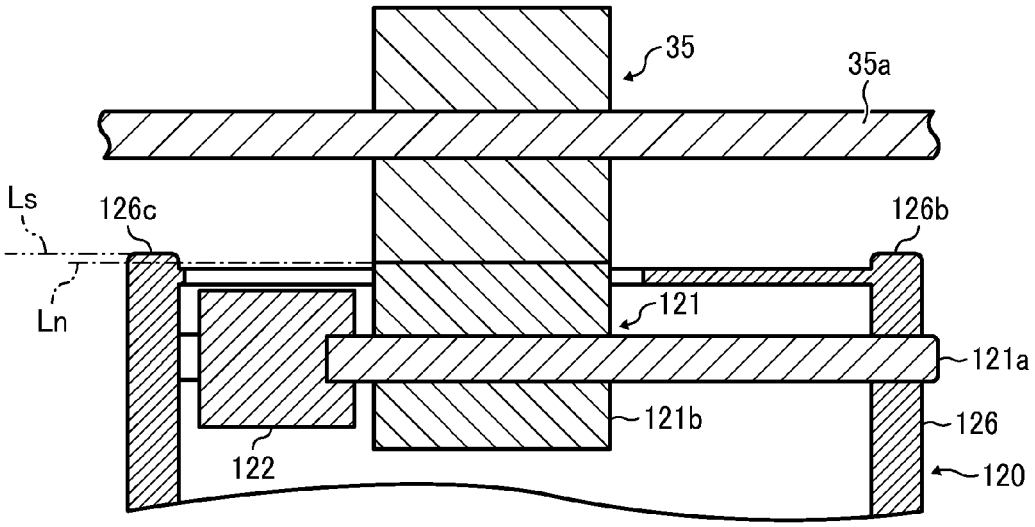
FIG. 14 is a vertical cross sectional view illustrating the sheet feeding roller and the separation roller unit of FIG. 13.

The sheet feed roller 35 has a rotary shaft 35*a* (FIG. 14).

As the sheet feed roller 35 rotates, an uppermost sheet S placed on top of the sheet stack is fed from the movable bottom plate 101. Then, the uppermost sheet S enters the sheet separation nip region formed by contact of the sheet feed roller 35 and a sheet separating roller 121. The sheet feed roller 35 that functions as a sheet feeding body and the sheet separating roller 121 that functions as a sheet separating body form a sheet separating part 210.

In the image forming apparatus 1000, as described above, the sheets S are fed from the sheet tray 100 as the sheet feed roller 35 is driven in a state in which the sheet S is pressed against the sheet feed roller 35 by a pressing device 400 including the movable bottom plate 101, the bottom plate pad 102, and the bottom plate spring 103. This configuration can achieve cost reduction by not providing a pickup roller for the sheet tray 100.

Generally, a rotation driving force is applied to the sheet separating roller 121 for moving the surface of the sheet separating roller 121 in a direction opposite to the direction of rotation of the sheet feed roller 35, as required. However, in the image forming apparatus 1000 according to the present example, such a rotation driving force is not applied to the sheet separating roller 121. The sheet separating roller 121 rotates by following the sheet feed roller 35 and the sheets S in the sheet separation nip region.

The sheet separating roller 121 has a rotary shaft 121*a* (see FIG. 10) and a cylindrical roller part 121*b* (FIG. 14). One end of the rotary shaft 121*a* of the sheet separating roller 121 is rotatably supported by a torque limiter 122 (see FIG. 10). When the sheet S is not in the sheet separation nip region, the sheet separating roller 121 contacts the sheet feed roller 35 directly. As the sheet feed roller 35 rotates in this state, a relatively large driving force is applied from the sheet feed roller 35 to the sheet separating roller 121. According to this configuration and operation, a torque of rotation of the sheet separating roller 121 exceeds a given threshold of the torque of rotation thereof, so that the torque limiter 122 causes the sheet separating roller 121 to rotate. That is, when the sheet S is not entered in the sheet separation nip region, the sheet separating roller 121 rotates with the sheet feed roller 35.

Further, when a single sheet S enters the sheet separation nip region, there are no sheets other than the single sheet S between the sheet separating roller 121 and the sheet feed roller 35. In this state, if the sheet feed roller 35 rotates, the sheet feed roller 35 exerts a strong conveying force on the sheet S, and therefore the sheet S moves in the sheet feeding direction. At the same time, the sheet feed roller 35 exerts a relatively strong driving force on the sheet separating roller 121 via the sheet S interposed therebetween. Consequently, the torque for rotating the sheet separating roller 121 with the sheet feed roller 35 exceeds a predetermined threshold value, so that the torque limiter permits the sheet separating roller 121 to rotate with the sheet feed roller 35. Specifically, when the single sheet S exists in the sheet separation nip region, the sheet separating roller 121 rotates with the sheet feed roller 35.

By contrast, it is assumed that two or more sheets S enter the sheet separation nip region in a form of layers due to multi feed. In this case, the sheet feed roller 35 exerts a relatively strong conveying force on the uppermost sheet S that is directly in contact with the sheet feed roller 35 in the sheet separation nip region, and therefore the uppermost sheet S is conveyed in the sheet feeding direction.

Further, the remaining sheets S other than the uppermost sheet S are pressed in the sheet separation nip region, and therefore are subjected to a conveyance resistance. This conveyance resistance exceeds a frictional resistance between the uppermost sheet S and a subsequent sheet S, that is, a second sheet S. Accordingly, a slip is induced between the uppermost sheet S and the subsequent sheet S. Due to this slip, the torque for causing the sheet separating roller 121 to rotate with the sheet feed roller 35 comes to be equal to or smaller than the predetermined threshold value, so that the torque limiter stops the sheet separating roller 121 from rotating with the sheet feed roller 35. This operation further increases the conveyance resistance exerted on the second and other subsequent sheets S. As a result, movement of the second and other subsequent sheets S is stopped. Thus, the sheet separating roller 121 exerts the conveyance resistance on the multiple sheets S and separates the uppermost sheet S from the other sheets S of the sheet stack.

The image forming apparatus 1000 having this configuration separates the sheets S in the sheet separation nip region without exerting a reverse-rotation driving force from a motor on the sheet separating roller 121. With this separation of the sheet S in the sheet separation nip region, a driving transmission device for transmitting driving to the sheet separating roller 121 is eliminated, thereby enabling cost reduction.

Figure 6:
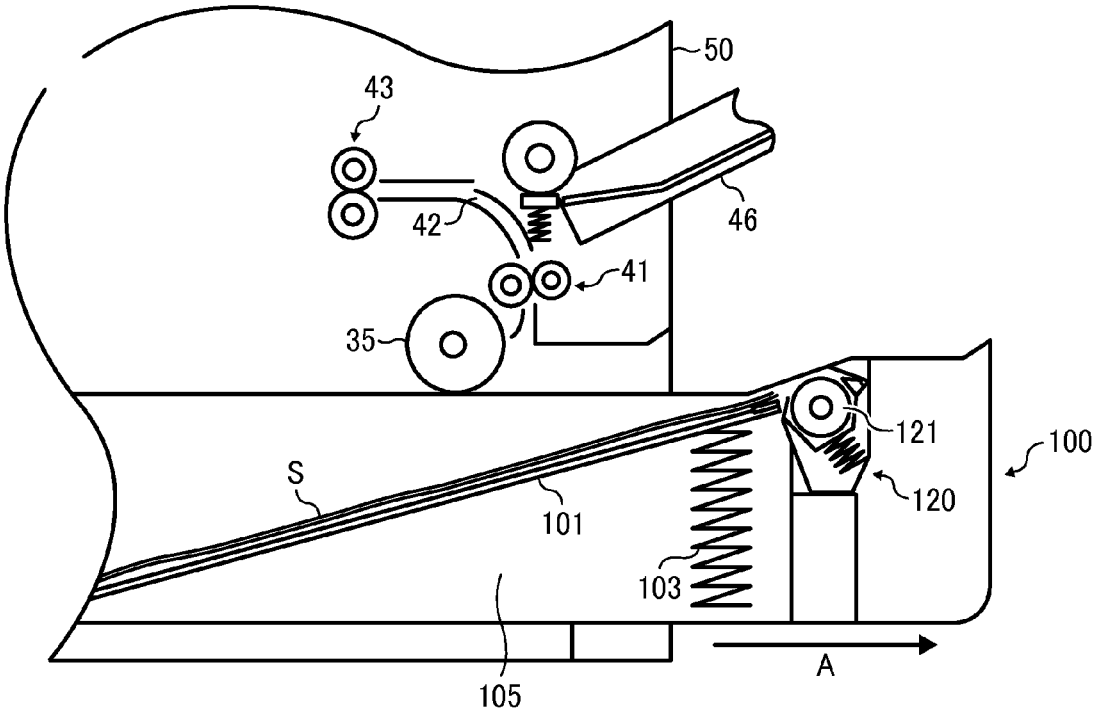
FIG. 6 is a partial enlarged view illustrating a sheet tray that is being pulled out from an apparatus body of the image forming apparatus of FIG. 1.

FIG. 6 is a partial enlarged view illustrating the sheet tray 100 that is pulled out from the apparatus body 50 of the image forming apparatus 1000.

As illustrated in FIG. 6, the image forming apparatus 1000 has the configuration in which the sheet separating roller 121 is held by the sheet tray 100 and is disposed detachably attachable to the apparatus body 50 together with the sheet tray 100. With this configuration, the sheet tray 100 can be detachably attached to the apparatus body 50 by sliding not in an axial direction of rotation of a roller such as the sheet feed roller 35 and the sheet separating roller 121 but in a left-to-right direction in FIG. 6. Since the sheet separation roller 121 moves together with the sheet tray 100, the sheet separating roller 121 does not obstruct sliding and moving of the sheet tray 100 in a direction indicated by arrow A along the left-to-right direction in FIG. 6. Hereinafter, the axial direction of rotation of a roller such as the sheet feed roller 35 and the sheet separating roller 121 is referred to as a "roller axis direction".

In the event of occurrence of a paper jam in a state in which the sheet S is being held in the sheet separation nip region, a user slides and moves the sheet tray 100 in the direction A in FIG. 6 to pull out the jammed sheet S from the apparatus body 50. Then, the sheet separating roller 121 is taken out therefrom together with the sheet tray 100, and therefore the sheet separation nip region is eliminated. However, the jammed sheet S is held in a sheet conveyance nip region formed by the first conveying roller pair 41, and, therefore remains in the apparatus body 50.

Since the sheet tray 100 is pulled out from apparatus body 50, space is generated within apparatus body 50. The space is largely opened in the direction A in FIG. 6, which is a sheet tray detaching direction. The user can easily and visually recognize the jammed sheet toward the surface thereof through this opening.

Further, the user can pull out the jammed sheet from the sheet conveyance nip region formed by the first conveying roller pair 41 while grasping the opposite end portions of the jammed sheet in the roller axis direction with his/her both hands inserted through the opening. At this time, respective pulling forces are exerted on the opposite end portions of the jammed sheet. By so doing, concentrations of the pulling forces are restrained and occurrence of tears of the jammed sheet can be substantially avoided in comparison with cases where the jammed sheet is grasped at one end portion thereof.

Accordingly, the image forming apparatus 1000 can restrain tears of jammed sheets during eliminating paper jams.

It is to be noted that the sheet tray pull-out direction of the image forming apparatus 1000 (i.e., the direction A in FIG. 6) is a direction in which the sheet tray 100 is moved from the side close to a sheet containing unit 105 toward the side close to the separation roller unit, as illustrated in FIG. 6.

Figure 7:
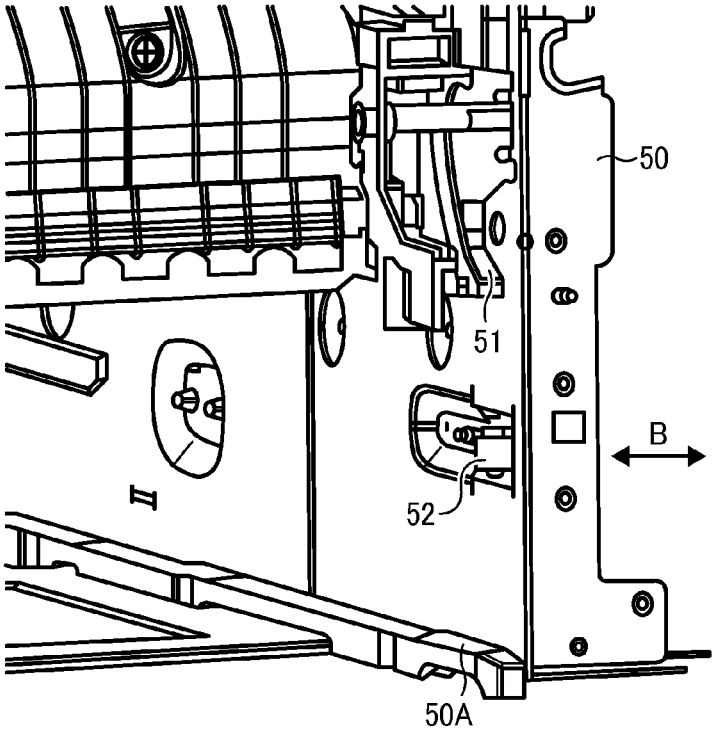
FIG. 7 is a partial perspective view illustrating the apparatus body with space therein due to withdrawal of the sheet tray of FIG. 6.

FIG. 7 is a partial perspective view illustrating the apparatus body 50 with space therein due to withdrawal of the sheet tray 100. A direction indicated by arrow B is the roller axis direction of the sheet feed roller 35. FIG. 7 illustrates one end portion of the sheet feed roller 35 in the roller axis direction in the apparatus body 50.

A rail 53 is disposed at one end of the identical roller axis direction of the sheet feed roller 35 on a bottom part of the apparatus body 50. The rail 53 extends in a sheet tray detaching/attaching direction in which the sheet tray 100 is detached and attached with respect to the apparatus body 50 of the image forming apparatus 1000. It is to be noted that another rail that is identical to the rail 53 is also disposed at the other end of the identical roller axis direction of the sheet feed roller 35 on the bottom part of the apparatus body 50.

The sheet tray 100 slides in a direction in which the rails 53 extend while being placed on the rails 53. By so doing, the sheet tray 100 can be detached and attached with respect to the apparatus body 50. Further, by placing the sheet tray 100 on the rail 53 and the rail disposed at the other end of the sheet feed roller 35 on the bottom part of the apparatus body 50, height of the sheet tray 100 in the apparatus body 50 can be positioned.

In FIG. 7, a member that extends vertically in the apparatus body 50 is a right side plate 50A of the apparatus body 50. Though not illustrated in FIG. 7, a left side plate of the apparatus body 50 is also disposed on the opposite end to the right side plate 50A in the identical roller axis direction. A positioning stopper 51 is mounted on an inner wall of the right side plate 50A. The positioning stopper 51 positions the sheet tray 100 in the apparatus body 50 in the sheet tray detaching/attaching direction. An identical positioning stopper is mounted on an inner wall of the left side plate of the apparatus body 50. The sheet tray 100 includes a contact part 108 (refer to FIG. 8). When the sheet tray 100 is placed on the rails 53 and inserted into the apparatus body 50, the sheet tray 100 abuts the contact part 108 against the positioning stopper 51. By so doing, the sheet tray 100 is positioned in the sheet tray detaching/attaching direction.

When the contact part 108 of the sheet tray 100 is simply abutted against the positioning stopper 51, if any impact or force is applied to the apparatus body 50, the sheet tray 100 is likely to be pushed in a tray removing direction.

To address the inconvenience, an engaging member 52 is disposed on an inner wall of a right side plate of the apparatus body 50 to be movable in the identical roller axis direction (as indicated by arrow B in FIG. 7). The engaging member 52 is biased by a spring, so that the engaging member 52 is restricted at a position projecting from the inner wall of the right side plate of the apparatus body 50 toward an inside of the apparatus body 50. As illustrated in FIG. 7, the engaging member 52 has a tapered portion. Even though FIG. 7 illustrates a single engaging member 52 thereon, another engaging member 52 is disposed on an inner wall of a left side plate of the apparatus body 50 that is identical to the engaging member 52 on the inner wall of the right side plate thereof.

Figure 8:
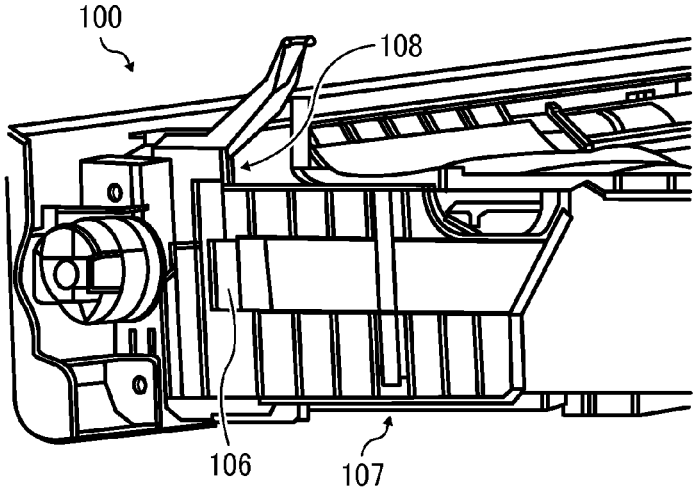
FIG. 8 is a partial perspective view illustrating the sheet tray viewed from a rear side thereof.

FIG. 8 is a perspective view illustrating a part of the sheet tray 100 viewed from a rear side thereof.

A tray fall prevention projection 106 is provided on an outer face of a right side plate of the sheet tray 100. A positioning part 107 is provided on an outer face of a bottom wall of the sheet tray 100. By putting the positioning part 107 on the rail 53 provided on the lower part of the apparatus body 50 illustrated in FIG. 7, the sheet tray 100 is positioned in the vertical direction.

As the sheet tray 100 is inserted into the inside of the apparatus body 50 toward the rear side of the image forming apparatus 1000, the tray fall prevention projection 106 of the sheet tray 100 slides on the tapered portion of the engaging member 52 of the apparatus body 50. Along with sliding of the sheet tray 100, the engaging member 52 is pressed toward the outside of the side plate, and therefore a projection amount of the tray fall prevention projection 106 from the inner face of the side plate is reduced.

Immediately before the sheet tray 100 abuts the contact part 108 against the positioning stopper 51 of the apparatus body 50 to be positioned, the tray fall prevention projection 106 of the sheet tray 100 separates from the engaging member 52 of the apparatus body 50. Then, the engaging member 52 that has reduced an amount of projection from the inner wall of the side plate (e.g., the right side plate 50A) projects instantly to a position illustrated in FIG. 7. By contacting a projecting part of the engaging member 52 to a back surface of the tray fall prevention projection 106, the sheet tray 100 is prevented from moving in the sheet tray detaching direction, that is, is restrained to a regular position. As a result, even if a sudden and unexpected impact is applied to the apparatus body 50, the sheet tray 100 can be correctly positioned and restrained in the sheet tray detaching/attaching direction.

It is to be noted that the engaging member 52 further has a taper having a sharp angle on a rear side thereof in FIG. 7.

Due to the tray fall prevention projection 106 of the sheet tray 100, a force such as an impact cannot pull down the engaging member 52. However, when the user pulls out the sheet tray 100 from the apparatus body 50 with a force greater than the impact force, the tray fall prevention projection 106 of the sheet tray 100 pushes down the engaging member 52 while sliding with a great force on the taper formed on the rear side of the engaging member 52. Consequently, the user can pull out the sheet tray 100 from the apparatus body 50.

As described above, by performing vertical positioning and horizontal positioning of insertion and removal of the sheet tray 100, the sheet separating roller 121 that is supported by the sheet tray 100 is positioned in the apparatus body 50 precisely.

It is to be noted that, in order to position the sheet tray 100 in a vertical direction more precisely, a positioning stopper such as the positioning stopper 51 on each of two side plates (i.e., the right side plate 50A and the left side plate) of the apparatus body 50 includes a rail part and a fine projection that slightly projects from a surface of the rail part. A fine positioning part provided to the sheet tray 100 runs aground to the fine projection. At the same time, a contact part (e.g., the contact part 108) of the sheet tray 100 is caused to abut against a pressed part of the positioning stopper 51.

Figure 9:
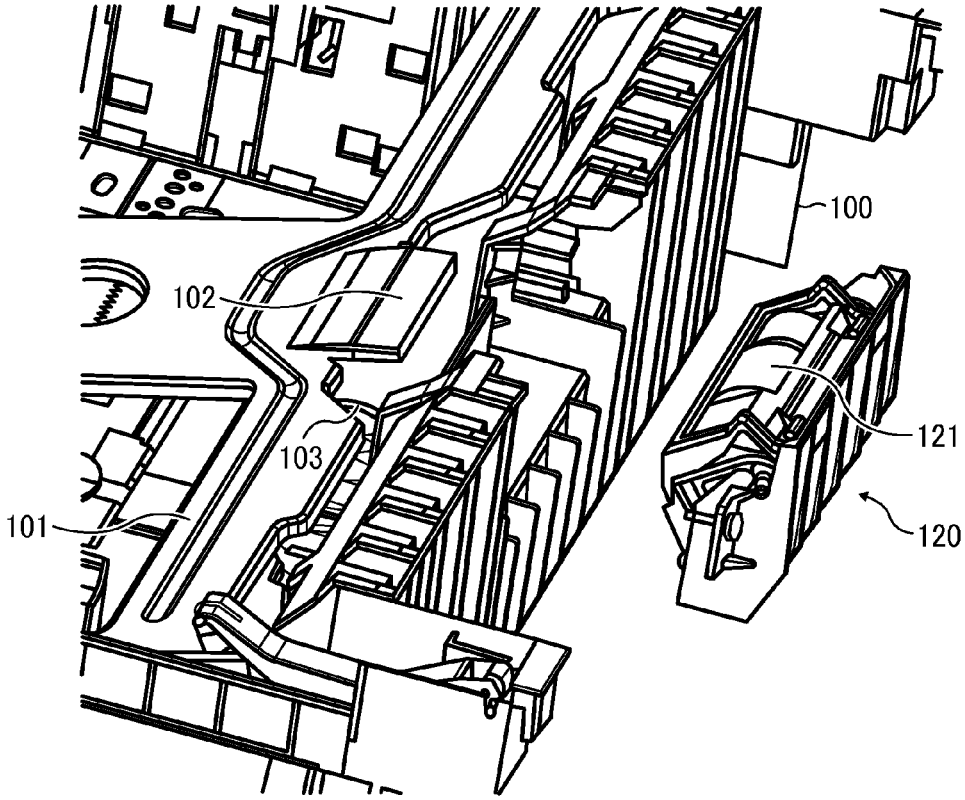
FIG. 9 is a partial perspective view illustrating the sheet tray viewed from a front side thereof.

FIG. 9 is a partial perspective view illustrating the sheet tray viewed from a front side thereof. In FIG. 9, a front cover, which is a cover provided with a pulling-out handle, in the sheet tray 100 is not illustrated, for convenience.

As illustrated in FIG. 9, the sheet separating roller 121 is structured to be included in a separation roller unit 120 together with in cooperation with other several components as described below. The separation roller unit 120 that functions as a sheet separating body storing unit is integrally attached and detached with respect to a receiving portion in the sheet tray 100. Thus, by making the sheet separating roller 121 into a unit, components can be standardized with other types of image forming apparatuses. Accordingly, a cost reduction can be achieved. Specifically, sheet trays other types of image forming apparatuses having different specifications from the image forming apparatus 1000 according to this example are also adapted to have the same configuration as the sheet tray 100 in the image forming apparatus 1000. However, such sheet trays in other types of image forming apparatuses are adapted to accommodate different numbers of sheets S from the sheet tray 100 in the image forming apparatus 1000. Therefore, the sheet trays in image forming apparatuses of different types are adapted to have different thicknesses thereof. Even such sheet trays having different specifications as described above are adapted to include the separation roller units 120 having completely the identical specifications to be attached and detached. Accordingly, standardization to use common components is achieved.

Figure 10:
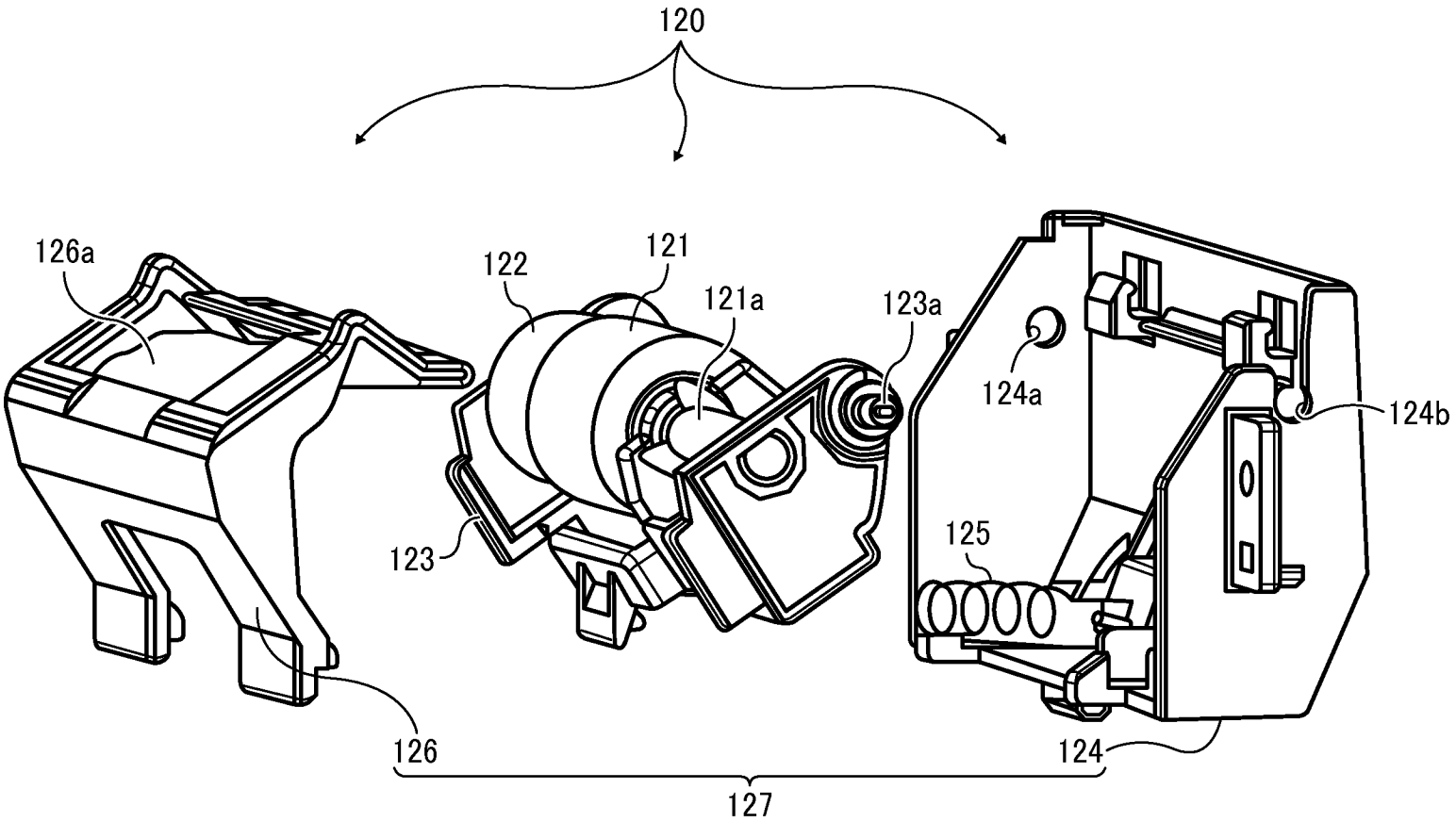
FIG. 10 is an exploded perspective view illustrating a separation roller unit included in the sheet tray.

FIG. 10 is an exploded perspective view illustrating the separation roller unit 120.

As illustrated in FIG. 10, the separation roller unit 120 includes the sheet separating roller 121, the torque limiter 122, a swing holder 123, a coil spring 125, a cover unit 127 including a top cover 126 and a base cover 124, and the like.

The one end of the rotary shaft 121*a* of the sheet separating roller 121 is rotatably supported by and connected to the torque limiter 122 (see FIG. 10). The functions of the torque limiter 122 is described above. The torque limiter 122 and the sheet separating roller 121 are held by the swing holder 123. The other side of the torque limiter 122, which is an opposite side thereof facing and being connected to the rotary shaft 121*a* of the sheet separating roller 121, is fixed to a right side plate of the swing holder 123. Further, the other end of the rotary shaft 121*a* of the sheet separating roller 121 is rotatably supported by a left side plate of the swing holder 123.

Accordingly, the swing holder 123 that holds the torque limiter 122 and the sheet separating roller 121 is contained in the cover unit 127 that functions as a containing device including the top cover 126 and the base cover 124. Specifically, respective swing shafts 123*a* are provided along a coaxial line on both the right side plate and the left side plate of the swing holder 123. The base cover 124 has a shaft hole 124*a* and a cutout 124*b*. One of the swing shafts 123*a* is engaged with the shaft hole 124*a* and the other of the swing shafts 123*a* is engaged with the cutout 124*b*. Accordingly, the swing holder 123 is supported by the base cover 124 so as to rotate about the swing shafts 123*a*.

The top cover 126 fits to the base cover 124 from above. In this state, a circumferential surface of the sheet separating roller 121 disposed inside the cover unit 127 is exposed through an opening 126*a* of the top cover 126 (see FIG. 9). The base cover 124 further includes the coil spring 125 that functions as a spring or a biasing member. The coil spring 125 is fixed to the base cover 124, so that the coil spring 125 biases the swing holder 123 centering the swing shaft 123*a* from the base cover 124 toward the top cover 126. When the separation roller unit 120 is not attached to the sheet tray 100 as illustrated in FIG. 9, the circumferential surface of the sheet separating roller 121 contacts a rear side of the top cover 126.

In the image forming apparatus 1000 according to this example, a right end face of the apparatus body 50 in FIG. 1 is a front side of the image forming apparatus 1000 and a left end face of the apparatus body 50 is the rear side of the image forming apparatus 1000. A far side or an inward side in a direction perpendicular to a sheet face of FIG. 1 is a right side of the apparatus body 50 and a near side or an outward side in the direction perpendicular to the sheet face of FIG. 1 is a left side thereof. Specifically, when detaching the sheet tray 100 that is placed inside the apparatus body 50 of the image forming apparatus 1000, a user pulls out the sheet tray 100 to the front side of the apparatus body 50. By contrast, when attaching the sheet tray 100, the user inserts the sheet tray 100 into the apparatus body 50 toward the rear side of the image forming apparatus 1000. Hereinafter, a direction from the rear side to the front side of the image forming apparatus 1000 along a tray attaching/detaching direction is referred to as a "front side direction" and an opposite direction to the front side direction is referred to as a "rear side direction".

Figure 11:
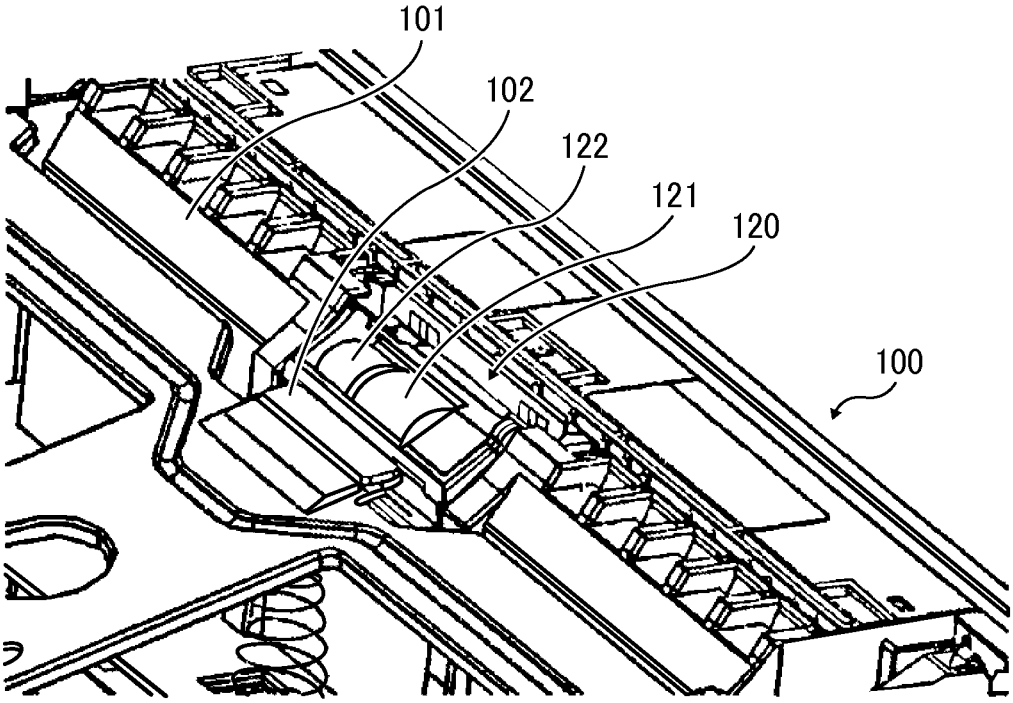
FIG. 11 is a partial perspective view illustrating a front end part of the sheet tray.

As illustrated in FIG. 11, when the separation roller unit 120 is attached to an attaching part of the sheet tray 100, the bottom plate pad 102 that is fixed to a leading end of the movable bottom plate 101 of the sheet tray 100 comes in the vicinity of the rear side of the sheet separating roller 121. As described above, the bottom plate pad 102 presses the sheet S accommodated in the sheet tray 100 toward the sheet feed roller 35.

Figure 12:
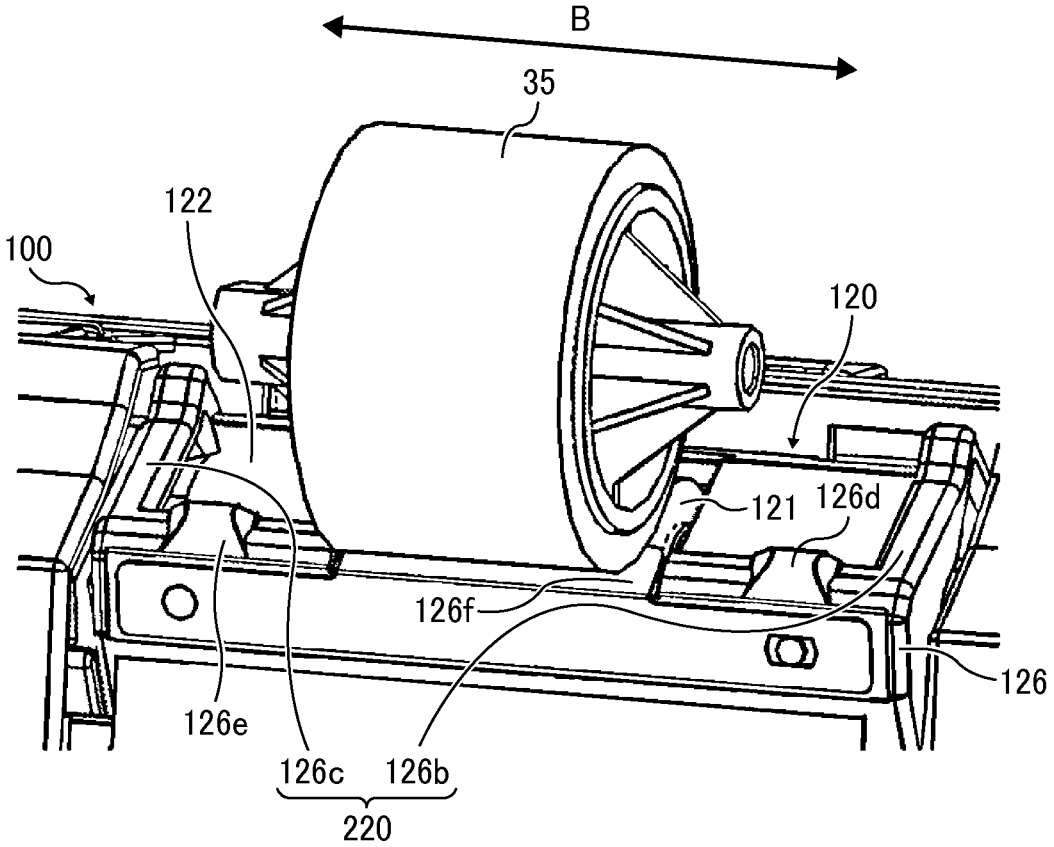
FIG. 12 is a partial perspective view illustrating the separation roller unit of the sheet tray installed in the apparatus body and a sheet feeding roller fixed in the apparatus body.

FIG. 12 is a partial perspective view illustrating a part of the separation roller unit 120 of the sheet tray 100 attached to a housing of the apparatus body 50 and the sheet feed roller 35 fixed to the housing of the apparatus body 50.

In the process of attaching the sheet tray 100 to the apparatus body 50 by slidably inserting the sheet tray 100 into the apparatus body 50, the sheet feed roller 35 that is fixed in the apparatus body 50 contacts the sheet separating roller 121 that is held by the sheet tray 100. Specifically, part of the outer circumferential surface of the sheet separating roller 121 before contacting the sheet feed roller 35 projects more outwardly than the top cover 126 through the opening 126*a* (FIG. 10) of the top cover 126 of the separation roller unit 120. In this state, the sheet separating roller 121 is pushed into the apparatus body 50 together with the sheet tray 100, and eventually abuts against the outer circumferential surface of the sheet feed roller 35 that is fixed in the apparatus body 50.

As the sheet tray 100 is further pushed and inserted into the apparatus body 50, the sheet separating roller 121 is pushed back by the sheet feed roller 35. Due to the push-back force of the sheet feed roller 35, the swing holder 123 starts to rotate about the swing shaft 123*a* from the top cover 126 toward the base cover 124 against the biasing force of the coil spring 125. By so doing, the sheet separating roller 121 gradually rotates about the swing shaft 123*a* from the sheet feed roller 35 toward the sheet separating roller 121. Accordingly, the contact part of both rollers gradually moves from the sheet feed roller 35 toward the sheet separating roller 121. When the sheet tray 100 is pushed to a regular attachment position, the sheet separating roller 121 is detached from the rear side of the top cover 126 completely, as illustrated in FIG. 13.

When a sheet having a large rigidity such as a thick paper is used as the sheet 5, it is likely that the large rigidity of the sheet S that is held in the sheet separation nip region applies a force to the sheet separating roller 121 to separate from the sheet feed roller 35. This application of the force to separate from the sheet feed roller 35 causes misfeeding of the sheet S due to the force. Specifically, due to the force, the swing holder 123 that is biased by the coil spring 125 as illustrated in FIG. 10 toward the sheet feed roller 35 rotates about the swing shaft 123*a* in a direction to separate from the sheet feed roller 35, so as to cause the sheet separating roller 121 to separate largely from the sheet feed roller 35. With this operation, a sheet conveying force applied by the surface movement of the sheet feed roller 35 does not transmit to the sheet S, which causes misfeeding of the sheet S.

The image forming apparatus 1000 further includes a sheet contact part 220 having a first contact part 126*b* and a second contact part 126*c* on the top cover 126 of the separation roller unit 120, as illustrated in FIG. 12.

Figure 13:
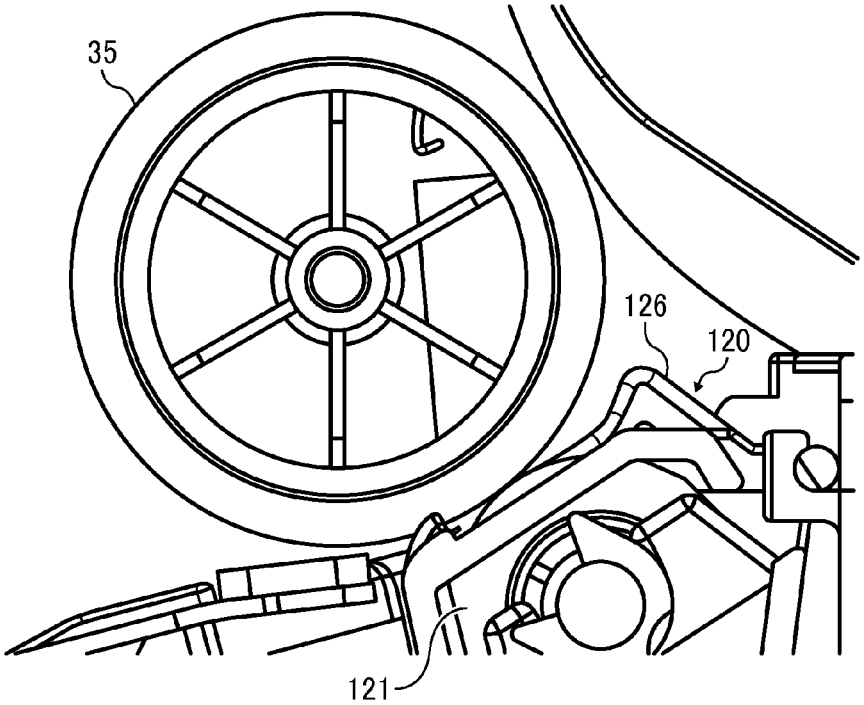
FIG. 13 is an enlarged view illustrating a sheet separation nip region and an area around the sheet separation nip region of the image forming apparatus of FIG. 1.

FIG. 14 illustrates a vertical cross sectional view of the sheet feed roller 35 and the separation roller unit 120 of FIG. 13. In FIG. 14, a dot-dashed line with a reference sign "Ln" indicates an extension of a straight line from the sheet separation nip region and another dot-dashed line with a reference sign "Ls" indicates an extension of a straight line from respective surfaces of the first contact part 126*b* and the second contact part 126*c* of the sheet contact part.

The first contact part 126*b* is aligned facing an end surface (i.e., the right end surface in FIG. 14) in the roller axis direction or rotation of the cylindrical roller part 121*b* of the sheet separating roller 121 and projects toward the sheet feed roller 35 than the sheet separation nip region in the apparatus body 50. That is, the first contact part 126*b* is disposed at a position at one end of the rotary shaft 121*a* of the sheet separating roller 121 from the cylindrical roller part 121*b* in the roller axis direction of the rotary shaft 121*a* thereof and projecting beyond the sheet separation nip region toward the sheet feed roller 35 in the apparatus body 50.

Further, the second contact part 126*c* is aligned facing an opposite end surface (i.e., the left end surface in FIG. 14) in the roller axis direction or rotation of the roller part 121*b* of the sheet separating roller 121 and projects toward the sheet feed roller 35 than the sheet separation nip region in the apparatus body 50. That is, the second contact part 126*c* is disposed at a position at an opposite end to the one end of the rotary shaft 121*a* of the sheet separating roller 121 from the cylindrical rotary shaft 121*a* in the roller axis direction and projecting beyond the sheet separation nip region toward the sheet feed roller 35 in the apparatus body 50.

Figure 15:
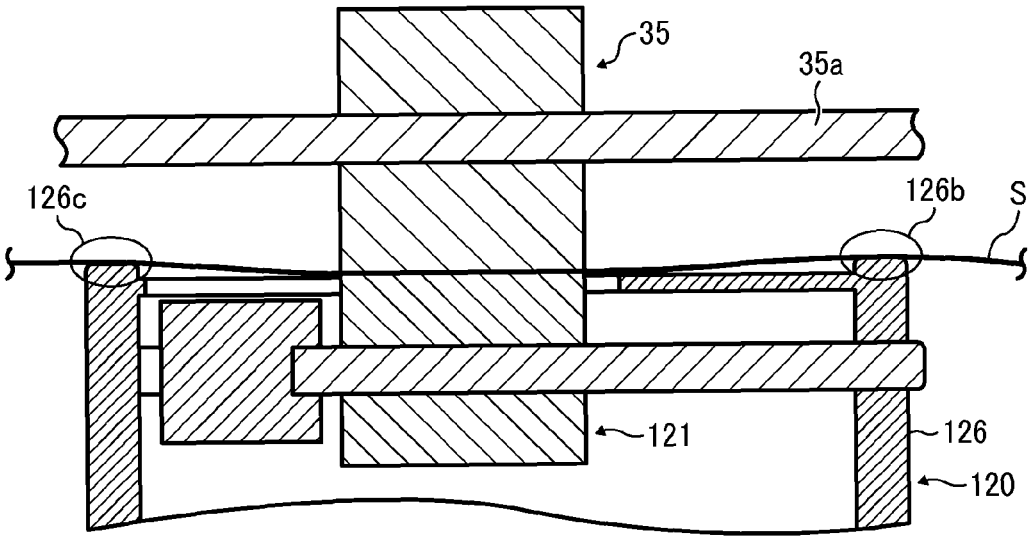
FIG. 15 is a vertical cross sectional view illustrating a state in which the sheet feeding roller and the sheet separation roller unit hold a sheet having a high rigidity in the sheet separation nip region formed therebetween.

As illustrated in FIG. 15, when the sheet S having a large rigidity is sandwiched in the sheet separation nip region, the sheet S has two slightly warping contact areas thereon in the entire region of the sheet S in the roller axis direction of the sheet S. Specifically, the sheet S slightly warps at a contact area contacting with the first contact part 126*b* and at another contact area contacting with the second contact part 126*c*. More specifically, the contact areas of the sheet S warp more toward the sheet separation nip region on the side of the sheet separating roller 121 than respective surfaces of the contact areas. Since the sheet S in FIG. 14 has a large rigidity, the sheet S attempts to eliminate the warp with a restoring force that is exerted by the sheet S. Therefore, the sheet S does not apply the force to separate the sheet separating roller 121 from the sheet feed roller 35. Accordingly, occurrence of misfeeding that is caused by which the sheet S having a large rigidity applies the above-described force to the sheet separating roller 121 in the sheet separation nip region can be prevented.

The sheet separating roller 121 has the circumferential surface, a part of which projects outside through an opening of the top cover 126. The part, which is hereinafter referred to as a "projecting surface", projects toward the sheet feed roller 35 from a surface of the top cover 126.

If the sheet S having a large rigidity abuts against the projecting surface of the sheet separating roller 121 before reaching the sheet separation nip region, the swing holder 123 rotates about the swing shaft 123*a* to a direction to separate from the sheet feed roller 35. It is likely that this rotation of the swing holder 123 significantly separates the sheet separating roller 121 from the sheet feed roller 35 to cause misfeeding of the sheet S. Specifically with a configuration in which the driving force of the motor is not transmitted to the sheet separating roller 121 as the image forming apparatus 1000 according to this example, even if the sheet separating roller 121 stops its rotation by abutting the projecting surface of the sheet separating roller 121, no driving force to rotate the sheet separating roller 121 reversely is transmitted. Accordingly, no force is applied with respect to the sheet S that abuts against the projecting surface of the sheet separating roller 121 to push the sheet S back to the sheet tray. Therefore, it is likely to cause misfeeding of the sheet S.

Therefore, the image forming apparatus 1000 further includes a sheet separation nip guide 126*f* that is fixed to the top cover 126, as illustrated in FIG. 12. The sheet separation nip guide 126*f* is a metal plate. The sheet separation nip guide 126*f* contacts the sheet S before the sheet separation nip region. By so doing, the sheet separation nip guide 126*f* prevents abutment of the sheet S against the projecting surface of the sheet separating roller 121 before the sheet S enters the sheet separation nip region and, at the same time, guides the sheet S toward the sheet separation nip region. By preventing the abutment, misfeeding of the sheet S due to the abutment can be prevented.

Figure 16:
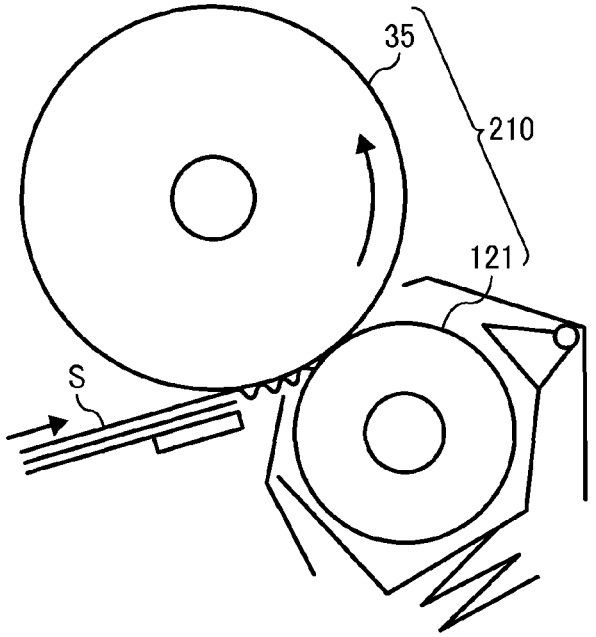
FIG. 16 is an enlarged view illustrating a sheet having a low rigidity that is waved immediately before the sheet separation nip region and a configuration around the sheet separation nip region.

When a sheet having a small rigidity such as a thin paper is used as the sheet 5, it is likely that crease is generated on the sheet S in the sheet separation nip region. For example, when the sheet separation nip guide 126*f* is not provided, the sheet S having a small rigidity abuts against the projecting surface of the sheet separating roller 121 before entering the sheet separation nip region, as illustrated in FIG. 16. Due to this abutment, a waved part having waves in a cross sectional view along the sheet conveying direction (as indicated by left arrow in FIG. 16) is formed. Since the waved part is held in the sheet separation nip region, crease is created in the sheet S.

Further, when the sheet separation nip guide 126*f* is provided, as the leading end of the sheet S having a small rigidity slides on the sheet separation nip guide 126*f*, the waved part is made to generate crease.

Figure 17:
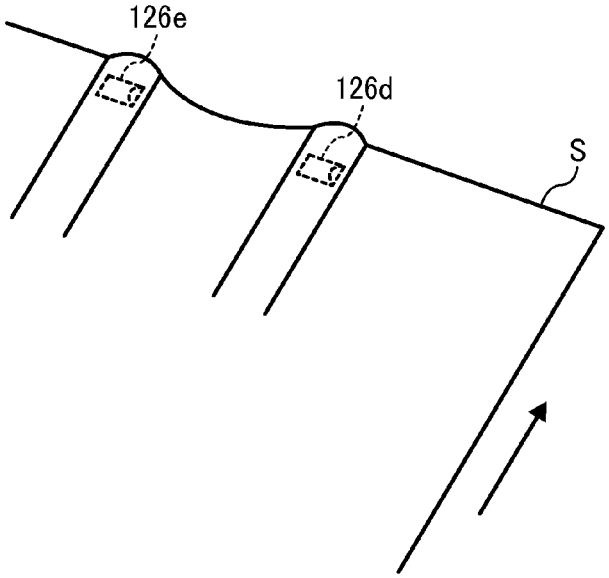
FIG. 17 is a partial perspective view illustrating a sheet warped by elasticity applying members.

As illustrated in FIG. 12, the image forming apparatus 1000 further includes a first elasticity applying member 126*d* and a second elasticity applying member 126*e* on the top cover 126 of the separation roller unit 120, so as to apply deflection to the sheet S. Each of the first elasticity applying member 126*d* and the second elasticity applying member 126*e* functions as an elasticity applying member. The first elasticity applying member 126*d* and the second elasticity applying member 126*e* contact the sheet S from below in the direction of gravity immediately before the sheet S enters into the sheet separation nip region. With this operation, as illustrated in FIG. 17, the sheet S having a small rigidity is bent to generate wrinkles along a sheet conveying direction of the sheet S (a direction indicated by arrow in FIG. 17). Due to generation of wrinkles on the sheet S by the first elasticity applying member 126*d* and the second elasticity applying member 126*e*, generation of different wrinkles extending in a direction perpendicular to the previously generated wrinkles can be prevented.

Waves formed on the sheet S illustrated in FIG. 16 are generated by bending or deflecting the sheet S in a direction perpendicular to deflection illustrated in FIG. 17. Therefore, since the first elasticity applying member 126*d* and the second elasticity applying member 126*e* apply deflection to the sheet S as illustrated in FIG. 17, the waves on the sheet S as illustrated in FIG. 16 can be prevented. Accordingly, this configuration can prevent occurrence of crease on the sheet S having a small rigidity in the sheet separation nip region.

When the sheet S with wrinkles thereon due to deflection applied by the first elasticity applying member 126*d* and/or the second elasticity applying member 126*e* enters the sheet separation nip region, the sheet S may have crease(s). That is, the first elasticity applying member 126*d* and the second elasticity applying member 126*e* provided to avoid such crease(s) can develop more crease(s).

In order to address this inconvenience, the image forming apparatus 1000 includes the configuration as illustrated in FIG. 12. Specifically, the sheet separating roller 121 illustrated in FIG. 12 shows the cylindrical roller part 121*b* thereof. The first elasticity applying member 126*d* is shifted to one end (to the right side) in the axis direction of rotation thereof (a direction indicated by arrow B in FIG. 12) from the roller part 121*b* of the sheet separating roller 121. In addition, the second elasticity applying member 126*e* is shifted to the other end in the axis direction of rotation thereof from the roller part 121*b* of the sheet separating roller 121.

By employing two elasticity applying members as described above, the wrinkles made on the sheet S due to the first elasticity applying member 126*d* and the second elasticity applying member 126*e* as illustrated in FIG. 17 are observed outside the sheet separation nip region in the axis direction of rotation. This configuration can prevent occurrence of crease due to entrance of the sheet S with the wrinkles made by the elasticity applying members (i.e., the first elasticity applying member 126*d* and the second elasticity applying member 126*e*) to the sheet separation nip region.

Further, when compared to a configuration provided with a single elasticity applying member, the configuration with two elasticity applying members as described above can increase the number of wrinkles to make the sheet S more rigid. By so doing, occurrence of crease can be prevented more reliably.

Figure 18:
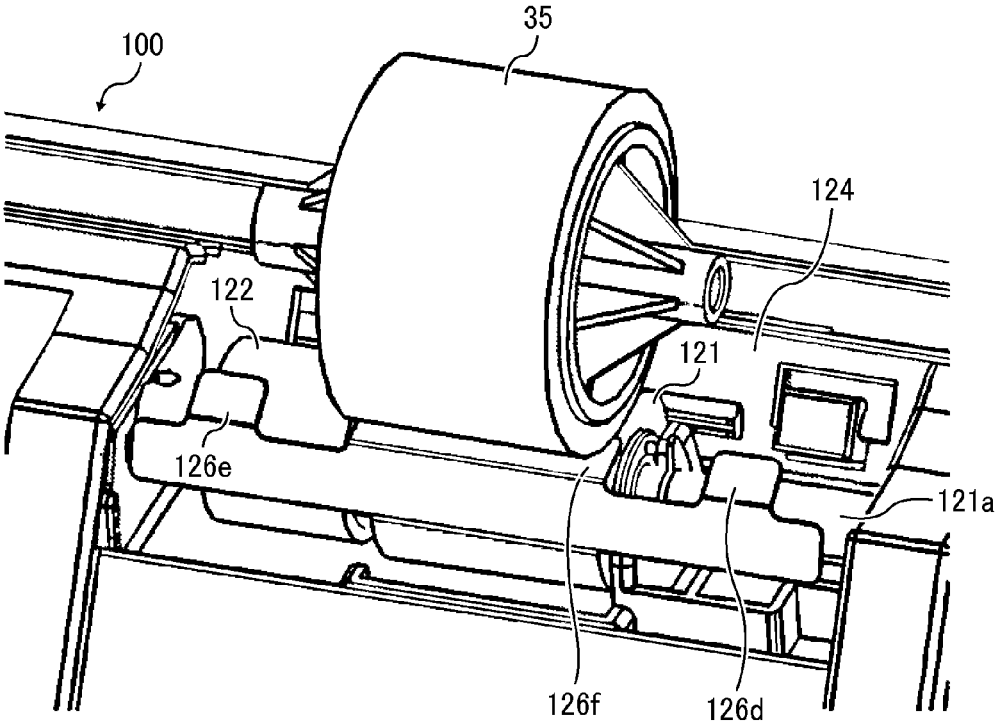
FIG. 18 is an exploded perspective view illustrating a sheet separating roller unit and units disposed around the sheet separating roller unit according to another example of this disclosure.

It is to be noted that the first elasticity applying member 126*d* and the second elasticity applying member 126*e* are provided integrally to the top cover 126. However, the configuration is not limited thereto and the first elasticity applying member 126*d* and the second elasticity applying member 126*e* can be provided separate from the top cover 126. For example, as illustrated in FIG. 18, the first elasticity applying member 126*d*, the second elasticity applying member 126*e*, and the sheet separation nip guide 126*f* may be provided on a single metal plate.

Now, a description is given of an image forming apparatus 1000A having an optional sheet containing unit. The optional sheet containing unit includes an optional sheet tray 100A that functions as at least one additional sheet container. It is to be noted that the optional sheet tray 100A is also referred to as multiple additional sheet containers when the at least one optional sheet tray 100A apparently includes multiple optional sheet containers.

Figure 19:
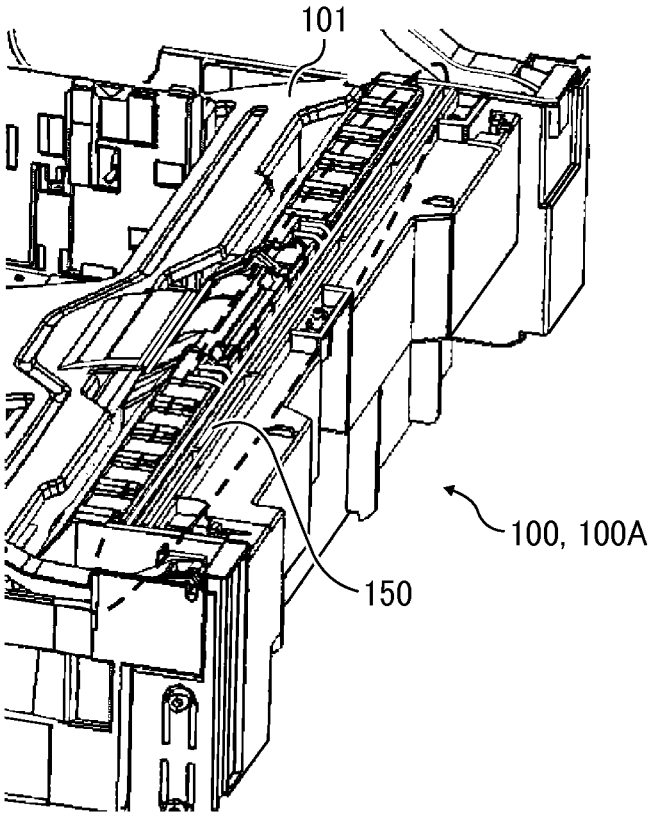
FIG. 19 is a partial perspective view illustrating a front end of the sheet tray when a front panel is removed.
Figure 20A:
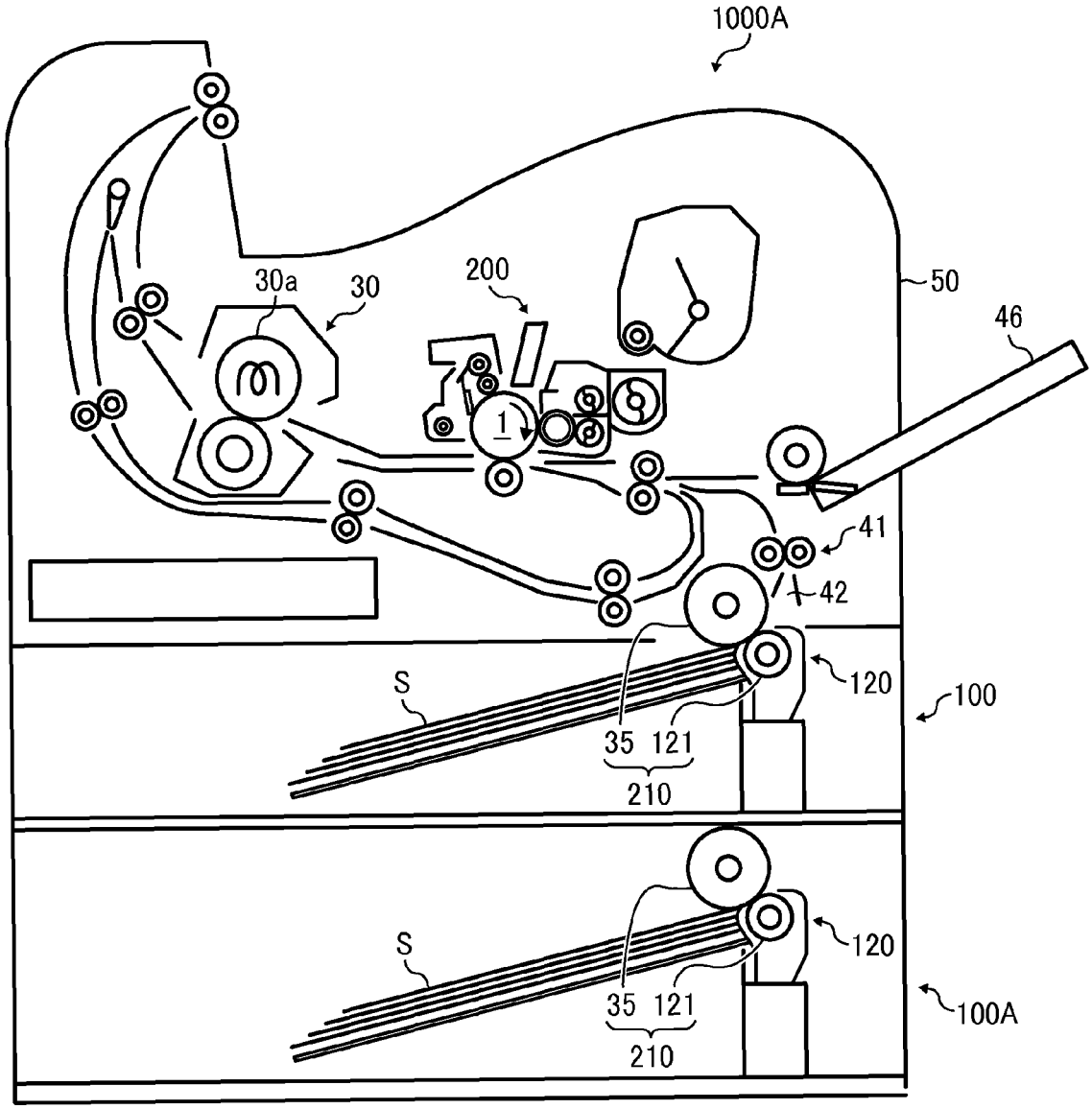
FIG. 20A is a diagram illustrating a configuration of a different image forming apparatus.
Figure 20B:
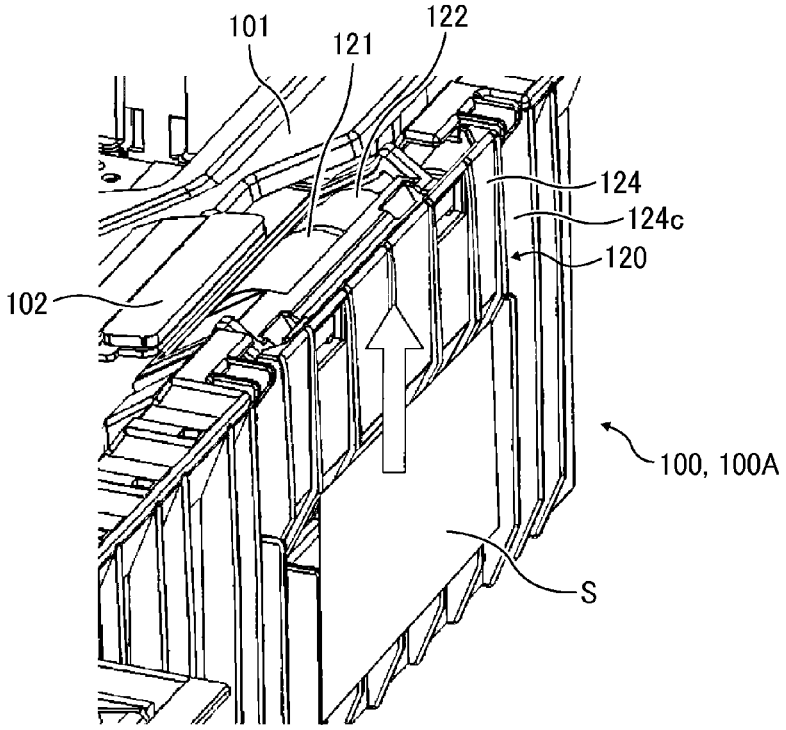
FIG. 20B is an exploded perspective view illustrating part of the front end of the sheet tray.
Figure 20C:
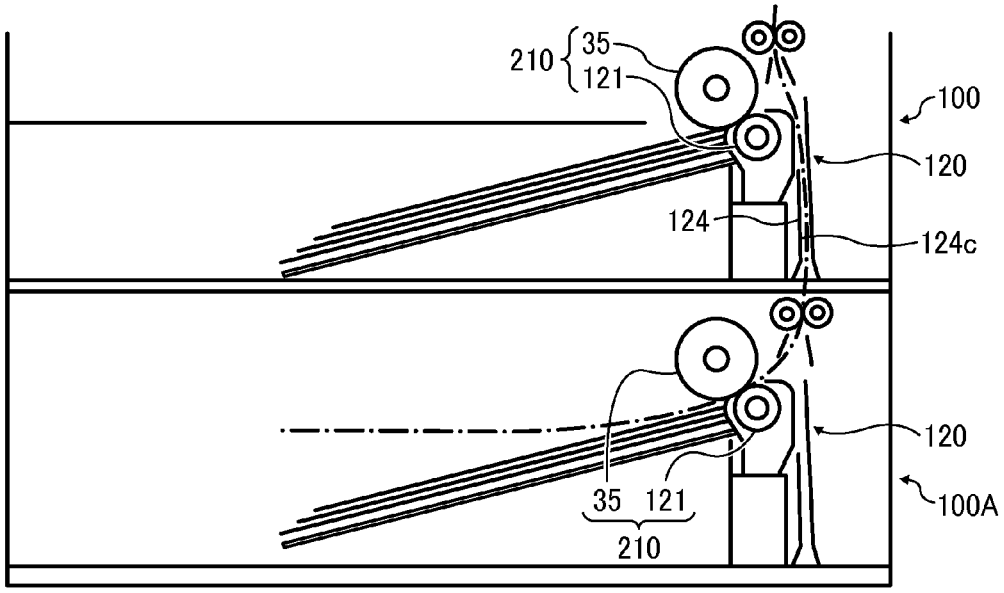
FIG. 20C is a cross sectional view illustrating the sheet container and an additional sheet container.

FIG. 19 is a partial perspective view illustrating a front end of the sheet tray 100 when a front panel is removed. FIG. 20A is a diagram illustrating a configuration of the image forming apparatus 1000A. FIG. 20B is an exploded perspective view illustrating part of the front end of the sheet tray 100. FIG. 20C is a cross sectional view illustrating the sheet tray 100 and the optional sheet tray 100A.

The configuration of the image forming apparatus 1000A illustrated in FIG. 20A is substantially based on the configuration of the image forming apparatus 1000 illustrated in FIG. 1. The optional sheet containing unit is installed immediately below the apparatus body 50 of the image forming apparatus 1000. As described above, the optional sheet containing unit includes the optional sheet tray 100A. Consequently, the optional sheet tray 100A is disposed immediately below the sheet tray 100 and basically includes identical units and devices to the sheet tray 100 illustrated in FIG. 1, and therefore the same reference numerals as the units and devices of the sheet tray 100 are employed to units and devices of the optional sheet tray 100A. Here, a detailed description of the units and devices of the optional sheet tray 100A identical to those of the sheet tray 100 is summarized and/or omitted. Further, when multiple optional sheet trays 100A are installed, the optional sheet trays 100A of the optional sheet containing unit have identical configurations to the optional sheet tray 100A illustrated in FIG. 20A and are located below the sheet tray 100.

The sheet tray 100A is disposed detachably attachable to the image forming apparatus 1000A.

In a case in which the optional sheet feeding unit is additionally provided to the image forming apparatus 1000, the sheet tray 100 and the optional sheet tray 100A are arranged at different positions in the vertical direction and the image forming part 200 is located above the sheet tray 100 and the optional sheet tray(s) 100A. In such a case, the sheet S that is fed from the optional sheet tray 100A is fed to the sheet conveying path 42 illustrated in FIG. 1 to be conveyed toward the image forming part 200. In order to do so, the sheet S is conveyed upward in the vertical direction inside of the sheet tray 100 and the optional sheet tray(s) 100A illustrated in FIG. 20A.

To achieve this conveyance of the sheet S toward the image forming part 200, as illustrated in FIG. 19, the sheet tray 100 and the optional sheet tray 100A further include an inner conveying path 150 to convey the sheet S fed from the optical sheet tray(s) 100A disposed below the apparatus body 50, so that the sheet S can travel in the sheet tray 100 and the optional sheet tray(s) 100A upwardly and vertically. Consequently, a front face 124*c* of the base cover 124 of the separation roller unit 120 functions as a sheet conveying guide in the inner conveying path 150 as illustrated in FIG.

20B and the sheet S is fed as indicated by a dashed line as illustrated in FIG. 20C. By employing the front face 124*c* of the base cover 124 as a sheet conveying guide, a reduction in cost and space can be achieved. It is to be noted that the front face 124*c* of the base cover 124 of the cover unit 127 that functions as a containing device of a lowest optional sheet tray 100A that is disposed at a lowest position of the multiple optional sheet trays 100A does not function as a sheet conveying guide since no sheet is conveyed along the inner conveying path 150 thereof.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an apparatus body;

a sheet container detachably attachable to the apparatus body, the sheet container accommodating recording media therein;

an image forming part to form an image on each of the recording media accommodated in the sheet container;

a sheet separating part to separate the recording media one by one from the sheet container and feed the recording medium toward the image forming part, the sheet separating part comprising a sheet feeding roller that has a rotary shaft and rotates about the rotary shaft thereof and a sheet separating body that has a rotary shaft, is held within the sheet container, the sheet separating body being a sheet separating roller that is detachably attachable to the apparatus body together with the sheet container, the sheet separating body rotating in contact with the sheet feeding roller and forming a sheet separation nip with the sheet feeding roller;

a sheet containing unit included in the sheet container to contain the recording media therein; and a sheet separating body storing unit included in the sheet container and disposed at one end of the sheet containing unit to store the sheet separating body therein, the sheet container being pulled out from the apparatus body in a direction that is perpendicular to an axial direction of rotation of the sheet separating roller by moving the sheet container along with the sheet separating body such that the sheet separating body is separated from the sheet feeding roller, wherein the sheet separating body storing unit includes a containing device that integrally contains the sheet separating roller and wherein the containing device comprises a sheet contact part that houses the sheet separating body, the sheet contact part including a first contact part disposed at a position closer to one end of the rotary shaft of the sheet separating roller than a cylindrical roller part in a rotation axis direction of the rotary shaft of the sheet separating roller and projecting beyond the sheet separation nip region toward the sheet feeding roller in the apparatus body; and a second contact part disposed at a position closer to an opposite end to the one end of the rotary shaft of the sheet separating roller than the cylindrical roller part in the rotation axis direction and projecting beyond the sheet separation nip toward the sheet feeding roller in the apparatus body, and the first contact part and the second contact part project only upstream from the sheet separation nip in a sheet feeding direction.

2. The image forming apparatus according to claim 1, wherein the sheet feeding roller is located above the sheet separating body and is pressed against the recording media in the sheet container attached to the apparatus body and feeds the recording media one by one from the sheet container to the sheet separation nip, wherein, when multiple recording media are fed from the sheet container and held in the sheet separation nip, the sheet separating part separates a recording medium that directly contacts the sheet feeding roller from the multiple recording media and feeds the recording medium toward the image forming part.

3. The image forming apparatus according to claim 2, further comprising a swing holder having a swing shaft to swingably hold the sheet separating body; and a biasing member to bias the swing holder toward the sheet feeding roller when the sheet container is attached to the apparatus body by biasing the swing holder in a given direction.

4. The image forming apparatus according to claim 3, wherein the sheet separating body storing unit is a separation roller unit that is detachably attached to the sheet container and the containing device integrally contains the swing holder, and the biasing member.

5. The image forming apparatus according to claim 4, wherein the sheet separating roller has the cylindrical roller part.

6. The image forming apparatus according to claim 4, further comprising a torque limiter to support the rotary shaft of the sheet separating roller, wherein, when a torque of rotation of the sheet separating roller exceeds a given threshold of the torque of rotation thereof, the torque limiter allows the sheet separating roller to rotate in contact with the sheet feeding roller in a sheet feeding direction, wherein, when the torque of rotation of the sheet separating roller is equal to or smaller than the given threshold of the torque of rotation thereof, the torque limiter stops the sheet separating roller from rotating with the sheet feeding roller.

7. The image forming apparatus according to claim 5, wherein the separation roller unit includes a sheet separation nip guide to prevent the recording medium from abutting against a circumferential surface of the sheet separating roller by contacting the recording medium before the recording medium enters the sheet separation nip and to guide the recording medium toward the sheet separation nip.

8. The image forming apparatus according to claim 5, wherein the separation roller unit includes an elasticity applying member to bend the recording medium having a small rigidity by contacting the recording medium before the recording medium enters the sheet separation nip and to generate wrinkles on the recording medium in the sheet feeding direction, wherein the elasticity applying unit is the first contact part and the second contact part.

9. The image forming apparatus according to claim 8, the elasticity applying member includes multiple elasticity applying members to contact the recording medium from below in a direction of gravity at different positions from each other in the rotation axis direction of the sheet separating roller, wherein the multiple elasticity applying members are the first contact part and the second contact part.

10. The image forming apparatus according to claim 9, wherein at least one of the multiple elasticity applying members is disposed at a position closer to the one end of the rotary shaft of the sheet separating roller in the rotation axis direction than the cylindrical roller part of the sheet separating roller and at least another one of the multiple elasticity applying members is disposed at a position closer to the opposite end of the rotary shaft of the sheet separating roller in the rotation axis direction than the cylindrical roller part of the sheet separating roller.

11. The image forming apparatus according to claim 5, further comprising at least one additional sheet container disposed vertically below the apparatus body, wherein the sheet container and the at least one additional sheet container are disposed below the image forming part, wherein the at least one additional sheet container includes multiple additional sheet containers, each including an additional sheet separating roller unit having an additional containing device, wherein the containing device of the sheet container and the additional containing device of each of the multiple additional sheet containers other than a lowest additional sheet container are a sheet conveying guide to convey the recording medium toward the image forming part.

12. The image forming apparatus according to claim 1, wherein the sheet feeding roller is affixed in the apparatus body.

* * * * *